US005470187A

United States Patent [19]

Smith et al.

[11] Patent Number: 5,470,187

[45] Date of Patent: Nov. 28, 1995

[54] FRONT-SIDE LIFTING AND LOADING APPARATUS

[75] Inventors: Fred T. Smith; Fred P. Smith, both of Alpine, Utah

[73] Assignee: Galion Solid Waste Equipment Co., Inc., Galion, Ohio

[21] Appl. No.: 118,564

[22] Filed: Sep. 9, 1993

[51] Int. Cl.[6] ..... B65F 3/02

[52] U.S. Cl. ..... 414/408

[58] Field of Search ..... 414/406–408, 414/303

[56] References Cited

U.S. PATENT DOCUMENTS

| | | | |
|---|---|---|---|
| 3,572,529 | 3/1971 | Anderson | 414/408 |
| 3,765,554 | 10/1973 | Morrison | 414/408 |
| 3,827,587 | 8/1974 | Liberman et al. | 414/408 X |
| 3,841,508 | 10/1974 | Ebeling et al. | 414/406 |
| 4,057,156 | 11/1977 | Thompson et al. | 414/408 |
| 4,085,857 | 4/1978 | Smith | 414/408 |
| 4,091,944 | 5/1978 | Gollnick | 414/408 X |
| 4,175,903 | 11/1979 | Carson | 414/408 |
| 4,986,074 | 1/1991 | Hahmann et al. | 414/408 X |
| 5,049,026 | 9/1991 | Bingman et al. | 414/408 |
| 5,222,853 | 6/1993 | Carson | 414/408 |
| 5,330,308 | 7/1994 | Armando et al. | 414/408 |

OTHER PUBLICATIONS

Hydraulics & Pneumatics, vol. 29, No. 9, Sep., 1976, pp. 118, 119, 122, "10–solenoid–valve control stick gives truck operator 'extra hands'", by E. C. Copeland.

*Primary Examiner*—David A. Bucci

*Attorney, Agent, or Firm*—Niro, Scavone, Haller & Niro

[57] ABSTRACT

A device for lifting and loading materials employs a pick-up arm for engaging material at ground level and an associated lift arm assembly. The pick-up arm can be swung relative to the lift arm about an axis that is generally perpendicular to the ground to bring the pick-up arm into a close-in position in front of a cab and into an outreaching position. The pick-up arm is automatically moved into the outreaching position as the lift arm moves toward a ground level load position and is automatically moved into the close-in position as the lift arm moves toward the off-load level above ground to facilitate off-loading operations above ground. The pick-up arm is also automatically maintained in a desired vertical relationship, parallel to the ground, as the lift arm moves between the load level and a predetermined level above ground level. When moved closer toward the off-load position, the pick-up arm is automatically vertically tipped to facilitate off-loading operations. The lift assembly can be controlled by a single operator using a single control lever. The lift arm can also be pivoted between a position next to the cab and a second position angularly spaced to one side of the cab. This can also be controlled by the single operator using the single control lever.

23 Claims, 14 Drawing Sheets

FRONT-SIDE LIFTING AND LOADING APPARATUS

FIELD OF THE INVENTION

The invention generally relates to systems and apparatus for lifting and loading materials into storage containers. The invention more particularly relates to systems and apparatus for the collection of waste materials.

BACKGROUND OF THE INVENTION

In many environments, there is a need to efficiently lift and load large volumes of materials. The collection of waste materials is a good example of one such environment.

The use of curbside waste collection containers is becoming more and more widespread. In this arrangement, waste materials are accumulated by a household in specially designed plastic or metal containers. The refuse crew empties the contents of these containers into waste collection vehicles using specially designed lifting and loading assemblies. By using these relatively large volume collection containers in association with specially designed lifting and loading assemblies, large volumes of waste materials can be collected by a refuse crew in a given period of time, compared to conventional hand loading operations.

Lifting and loading mechanisms that engage the container in the front of the waste collection vehicle are in common use. These mechanisms conventionally have two curved arms that clear the cab in front of the vehicle and a pair of forks that fit into side or bottom pockets of a steel collection container. Other mechanisms employ a triangular frame in front of the cab that locks into a triangular pocket on the rear face of a plastic collection container.

Use of these mechanisms is limited, however, because they can only lift a container located straight ahead of the vehicle.

Another example of a lifting assembly is shown in Edelhoff et al. U.S. Pat. No. 4,715,767. In this patent, a lift arm is arranged to pick-up the containers along the side of the cab. This provides operator greater flexibility and speed in waste collection operations.

One objective of this invention is to provide a lifting and loading apparatus that is compact and readily adaptable for use in association with a chassis mounted collection system where tare weight and weight distribution considerations are important.

Another objective of this invention is to provide a lifting and loading apparatus that performs all intended operations with a single control lever.

Yet another objective of this invention is to provide a lifting and loading apparatus that can readily accommodate both front and side pick-up operations.

Still another objective of this invention is to provide a lifting and loading apparatus that provides a good view of the work station from the left hand side of the cab, thereby eliminating the need for a right hand drive station in the cab.

SUMMARY OF INVENTION

The invention provides a device for lifting and loading materials that achieves these and other objectives. The device includes a frame that carries a storage container. The storage container has an inlet opening that is located above ground level. A pick-up arm and associated lift assembly are provided that engage material at ground level for loading through the inlet opening of storage container.

In accordance with one aspect of the invention, the lift assembly includes a lift arm connected at one end to the frame and at another end to the pick-up arm. First actuating means is provided for swinging the pick-up arm relative to the lift arm about an axis that is generally perpendicular to the ground. The pick-up arm is thereby movable to an outreaching position to pick-up material off to the side of the container and then to a close-in position along the section of the storage container where the inlet opening is located. Second actuating means is also provided for moving the lift arm relative to the frame between a load level, at which the pickup arm is located at a selected height near ground level, and an off-load level, at which the pick-up arm is raised to the level of the inlet opening. This aspect of the invention provides first controlling means that interconnects the first and second actuating means. The first controlling means automatically moves the pick-up arm into the outreaching position as the lift arm moves toward the load level, thereby facilitating the pick-up of materials located away from the storage container. The first controlling means also automatically moves the pick-up arm into the close-in position as the lift arm moves toward the off-load level, thereby facilitating the off-loading of such materials through the inlet opening and into the storage container. In a preferred embodiment, the first controlling means can be selectively disabled to maintain the pick-up arm in the close-in position during movement of the lift arm between its load and off-load levels, thereby facilitating pick-up of materials in front of the container.

In another aspect of the invention, the lift arm further includes third actuating means that moves the pick-up arm relative to the lift arm about an axis that is generally parallel to the ground. Second controlling means interconnects the second actuating means and the third actuating means for automatically maintaining the pick-up arm in a desired relationship relative to the lift arm as the lift arm moves between a load level and the off-load level. In this arrangement, the third actuating means moves the pick-up arm between an load position, in which materials engaged by the pick-up arm are held generally parallel to the ground, and an off-load position, in which materials engaged by the pickup arm are tipped in the direction of the inlet opening of the storage container to facilitate off-loading therein. In a preferred embodiment, the second controlling means automatically maintains the pick-up arm in the load position as the lift arm moves between the load level and a predetermined level above ground level. It also automatically moves the pick-up arm from the load position to the off-load position as the lift arm moves from the predetermined above-ground level to the off-load level.

In a preferred embodiment, the lift assembly also includes fourth actuating means that moves the lift arm relative to the frame from an first position close to the frame and a second position spaced away from the frame. A greater reach for material located along the side of the container is thereby achieved.

Another aspect of the invention provides speed control means that automatically increases the velocity of movement of the pick-up arm as it moves from the outreaching position toward the close-in position until a desired intermediate position is reached. The speed control means then automatically decreases the velocity of movement of the pick-up arm as it moves from the intermediate position toward the close-in position. In a preferred embodiment, the speed control means conversely automatically increases the velocity of movement of the pick-up arm as it moves from the close-in position toward the intermediate position, and then decreasing the velocity of movement as the pick-up arm moves from the intermediate position toward the outreaching position.

In a preferred embodiment, the various control mechanisms provided by the invention are actuated in response to fluid pressure.

Other features and advantages of the invention will become apparent upon review of the drawings, description, and claims.

DESCRIPTION OF THE PREFERRED EMBODIMENTS

Figure 1:
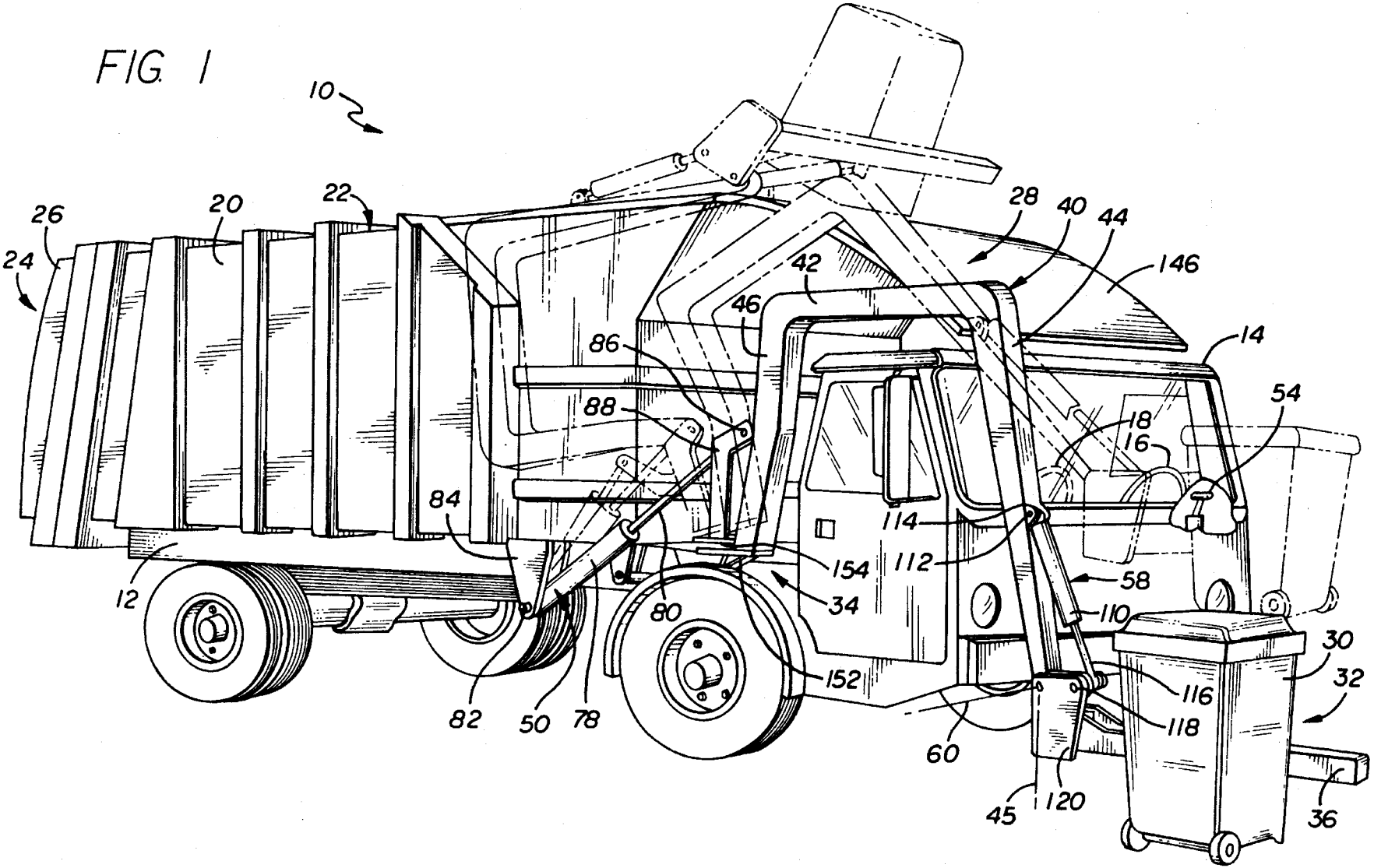
FIG. 1 is a side perspective view of a waste collection vehicle having a lifting and loading assembly that embodies the features of the invention.

A vehicle 10 for collecting and transporting waste materials is shown in FIG. 1. The vehicle 10 includes a wheeled chassis or frame 12. The driver's compartment or cab 14 is located at the front end of the chassis, as is the engine (not shown) that propels the vehicle.

As shown in FIG. 1, the vehicle 10 has a single left-hand steering wheel 16. Alternatively (as shown in phantom lines in FIG. 1), two steering wheels can be provided, the normal left-hand one 16 and a special right-hand one 18, located on the side where curbside refuse collection containers are picked up. However, as will become apparent, the invention effectively eliminates the need for a second steering wheel on the right-hand side of the cab.

A container 20 having a relatively large volume interior collection area (for example, twenty (20) cubic yards) is carried on the frame 12 behind the cab 14. Waste materials are loaded into the container 20 for transportation to a disposal or recycling site.

The container 20 includes an inlet opening 22 located in the top front section. Waste materials are loaded into the collection area through this inlet opening 22.

The container also conventionally includes a rear opening 24 (see FIG. 1), with a pivotally attached tailgate 26, through which the waste materials are off-loaded from the interior area. A conventional packing/ejector panel (not shown) is movable within the container 20 to pack the waste materials (when the tailgate 26 is closed) and to push the waste materials out of the container (when the tailgate is opened) at a transfer station, landfill, or recycling center. The ejector panel is conventionally actuated by a conventional double-acting telescopic hydraulic cylinder (also not shown).

In accordance with the invention, the vehicle includes an apparatus 28 carried on the frame 12 for lifting and loading waste materials into the inlet opening 22.

In the particular embodiment shown (see FIGS. 1 to 5), the apparatus 28 engages one or more conventional curbside waste collection containers 30 from a ground level load position (shown in FIGS. 1 and 2), located either in front or along the right hand side of the vehicle 10. The apparatus 28 then lifts these containers 30 in front of and above the cab 14 (shown in phantom lines in FIG. 1 and in the sequence shown in FIGS. 3 to 5) to dump their contents through the inlet opening 22 into the collection container 20. The apparatus 28 then reverses and returns the emptied collection containers to their original pick-up position along side or in front of the vehicle 10.

Due to the features of the invention, the driver can operate the apparatus 28 from within the cab 14, from either a left or right hand steering location.

Figure 2:
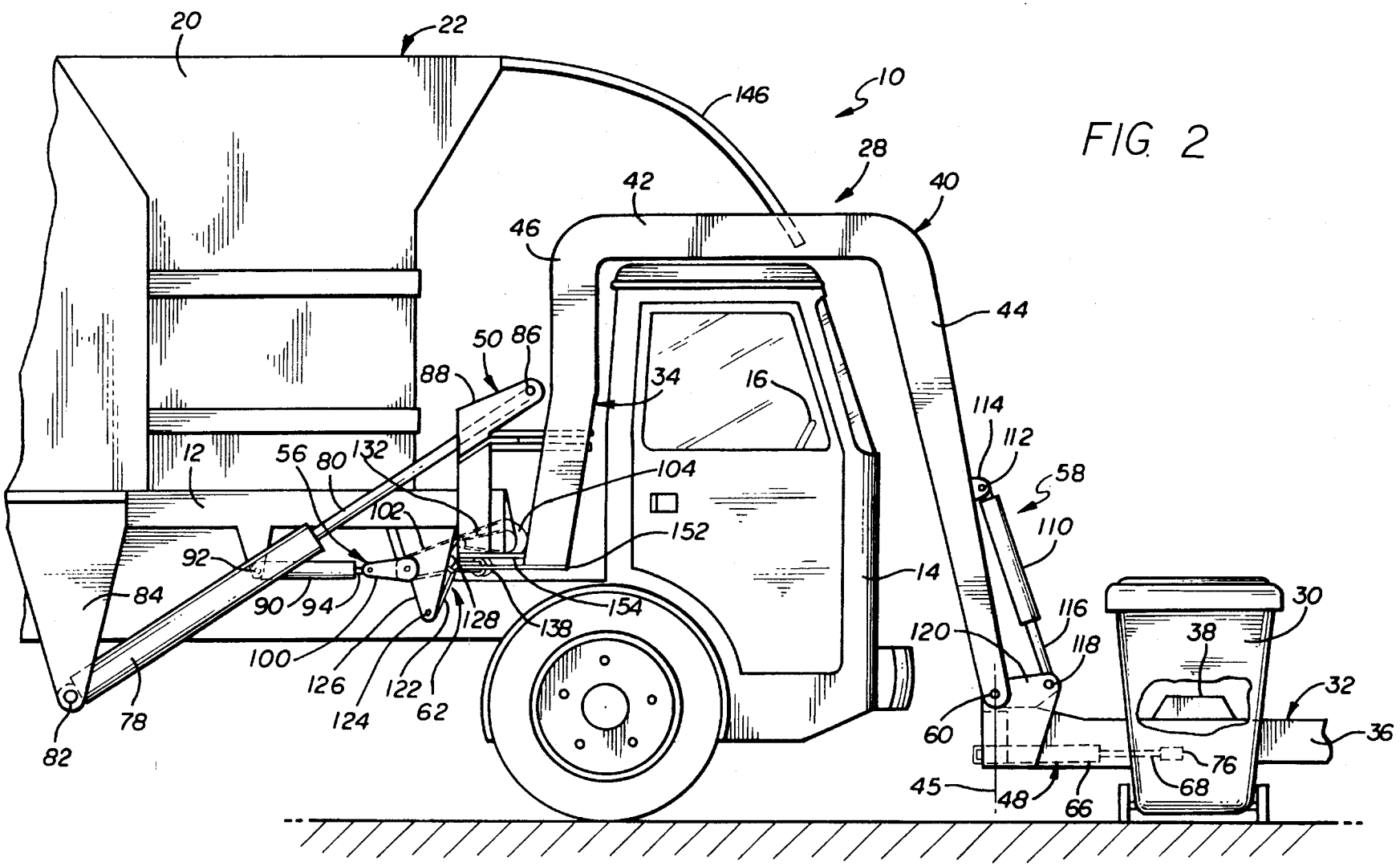
FIG. 2 is a side elevation view of the front end of the vehicle shown in FIG. 1, showing the lifting and loading assembly in a ground level load position.

In carrying out the above described sequence of operation, the apparatus 28 includes a pick-up arm 32 for engaging one or more collection containers 30 at ground level (as shown in FIG. 2). The apparatus 28 also includes a lift assembly 34 for positioning and raising the pick-up arm 32 in the manner generally shown in FIGS. 3 to 5.

The pick-up arm 32 comprises an elongated bar 36 that, in length, generally matches the transverse width of the vehicle's wheelbase. The pick-up arm 32 also includes a suitable gripping mechanism or grabber 38 (shown schematically in FIG. 2). In use, the mechanism 38 engages the containers 30 to be lifted. The gripping mechanism or grabbers 38 can vary according to the type of container used. For example, when Edelhoff-style DIN containers are used, the gripping mechanism 38 can take the form of the latching members shown in Edelhoff et al U.S. Pat. No. 4,715,767, which is incorporated herein by reference. Alternatively, when round containers are used, the gripping mechanism 38 can constitute conventional grabbers or arms. The particular form of the gripping mechanism or grabbers 38 selected depends entirely upon the type of container being loaded and does not constitute a part of the present invention.

The lifting assembly 34 includes a lift arm 40. As shown in FIGS. 1 to 5, the lift arm takes the configuration of an inverted U, having a horizontal cross bar section 42 and a pair of front and rear downwardly depending legs, respectively 44 and 46. In its lowermost position above the ground (see FIGS. 1 and 2), the cross bar section 42 extends just above the top of the cab 14, so as not to interfere with the driver's front or side views. The end portion of the rear lift arm leg 46 is attached to a plate 152, which in turn is pivotably attached, via pivot axle 148 (FIGS. 6–7), to a plate 154. The plate 154 is further attached to a tilt axle 104 carried by the frame 12 near the front end of the container 20, behind the cab 14 (see FIGS. 6 to 8). The front lift arm leg 44 extends just in front of the side of the cab 14, again so as not to interfere with the driver's front and side views. The end portion of the front lift arm leg 44 is attached to the pick-up arm 32. When in its lowermost position above the ground (again, see FIGS. 1 and 2), the front lift arm leg 44 holds the pick-up arm 32 at a desired minimum height above ground level. In the illustrated embodiment, this is generally at axle height of the vehicle 10.

Figure 10:
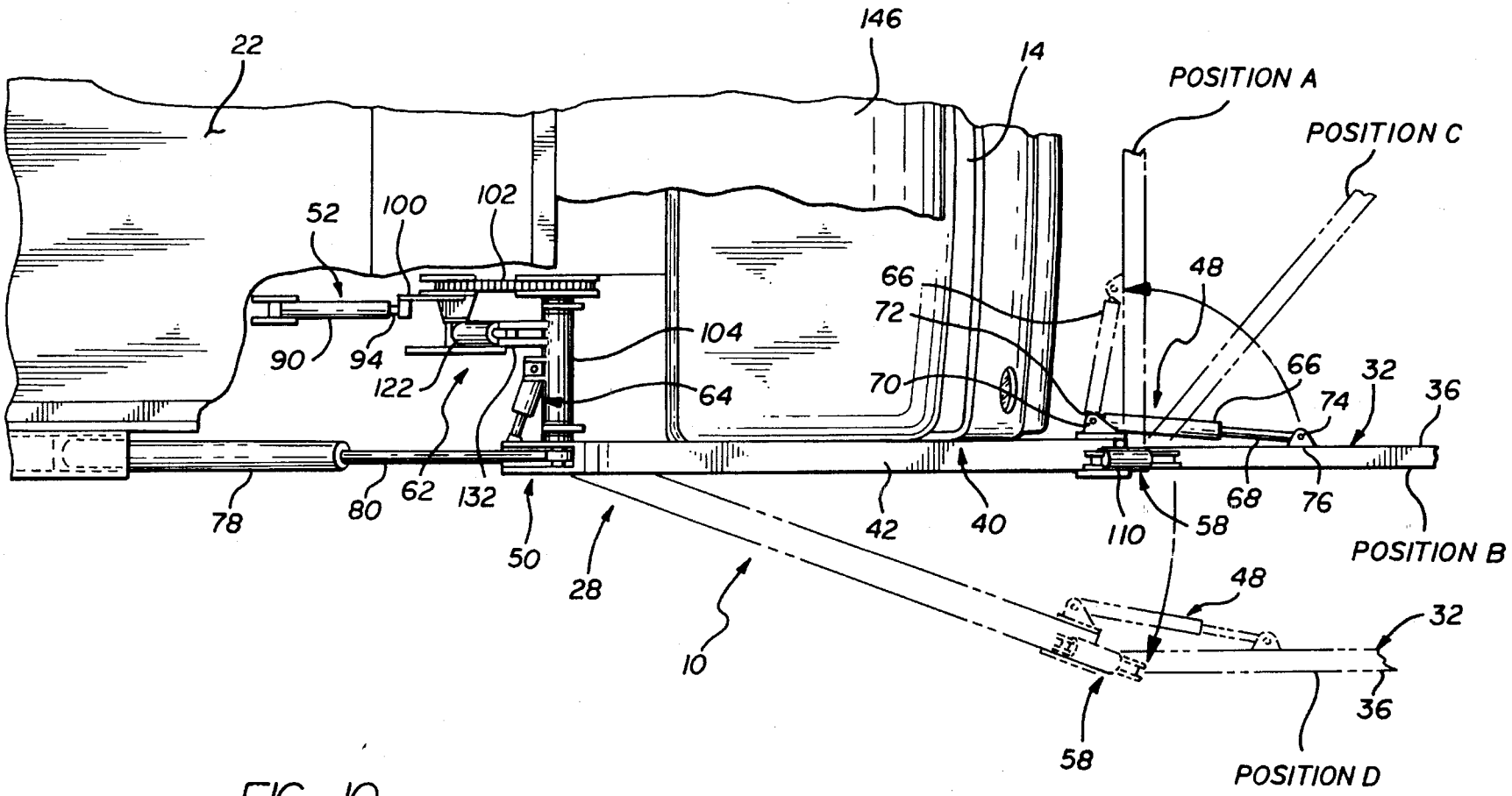
FIG. 10 is a top view of the front end of the vehicle shown in FIG. 9, with portions broken away, showing the lateral side movement of the lifting and loading assembly from a different perspective.

As best shown in FIG. 10, the apparatus 28 further includes a first actuating mechanism 48 for laterally swinging the pick-up arm 32 relative to the front lift arm leg 44 about an axis 45 that is generally perpendicular to the ground (see also FIG. 2). This lateral swinging motion serves to move the pick-up arm between a close-in position along the front of the vehicle 10 (shown in phantom line Position A in FIG. 10) and an outreaching position spaced away from and off to the right hand side of the vehicle 10 (shown in solid line Position B in FIG. 10). The apparatus 28 is thereby capable of picking up containers 30 either in the front of the vehicle 10 (when in Position A) or off to the right hand side of the vehicle 10 (when in Position B), using the particular gripping mechanism 38 associated with the pick-up arm 32.

Figure 3:
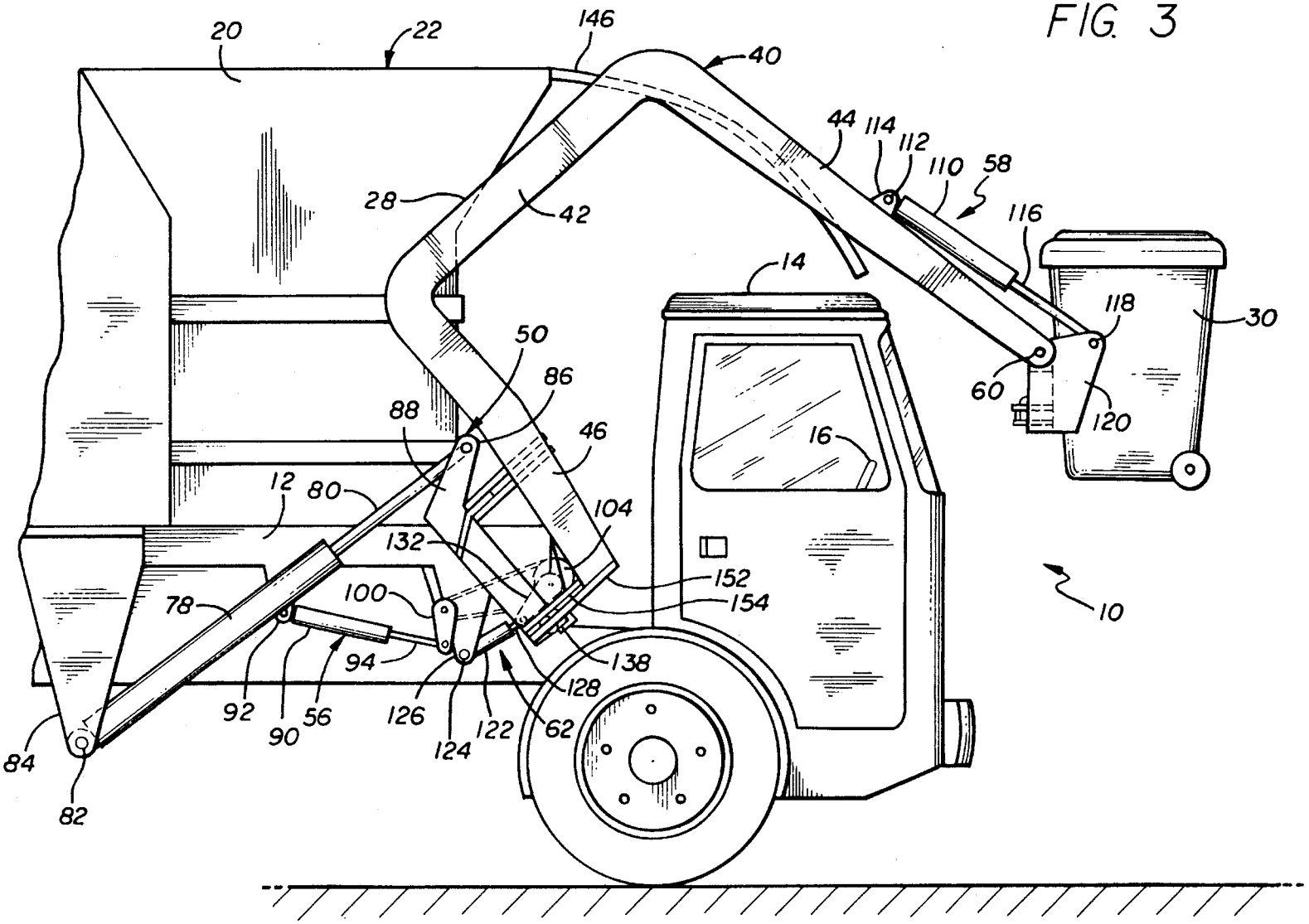
FIG. 3 to 5 are side elevation views similar to FIG. 2, showing the sequential operation of the lifting and loading assembly in raising a collection container into an upraised off-load position.
Figure 4:
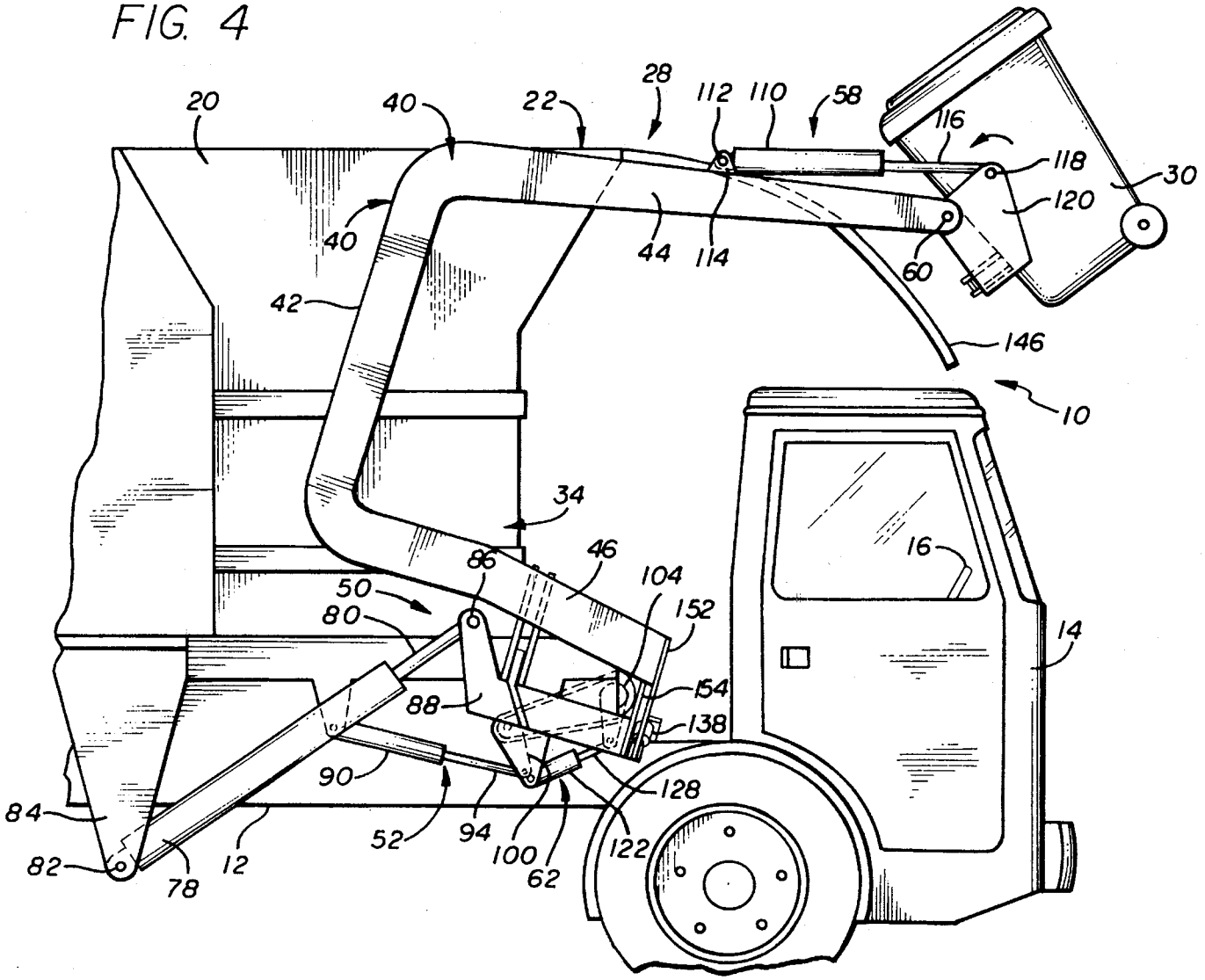
Figure 5:
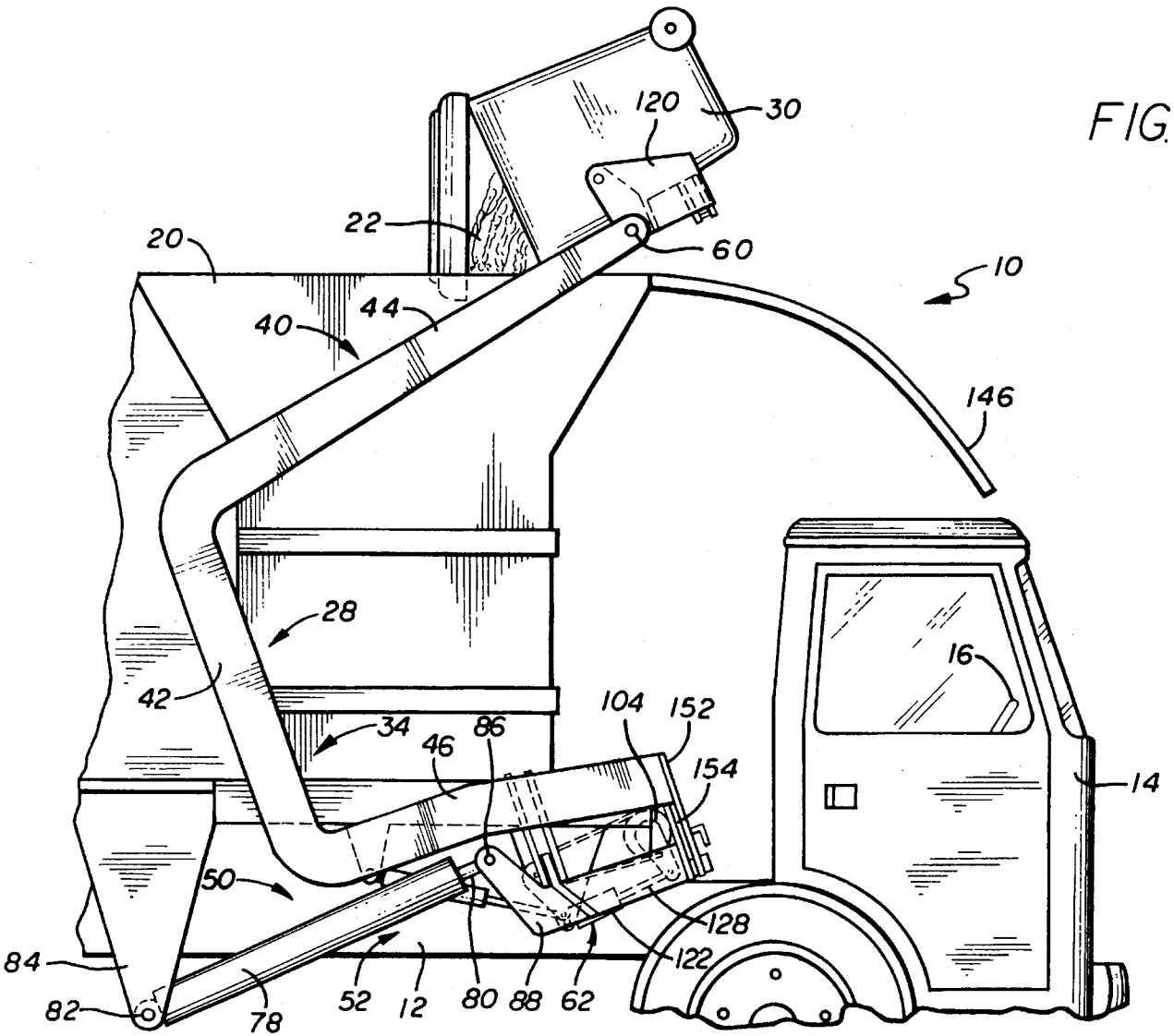

As shown in FIGS. 2 to 5, the apparatus 28 further includes a second actuating mechanism 50 for moving the lift 27 arm 40 about the tilt axle 104 between a load level, shown in FIGS. 1 and 2, at which the pick-up arm 32 is located at the selected height near ground level, and an off-load level, shown in FIG. 5, at which the pick-up arm 32 is raised to the level of the inlet opening 22. Intermediate FIGS. 3 and 4 show the sequence of movement between the load level and the off-load level.

For the situation where the collection container 30 is to be picked up along the right hand side of the vehicle, the apparatus provides a first controlling mechanism 52 (FIGS. 4–5) that interconnects the first and second actuating mechanisms 48 and 50 to coordinate the lateral swinging movement of the pick-up arm 32 with the up and down movement of the lift arm 40.

More particularly, the first controlling mechanism 52 automatically moves the pick-up arm 32 into its outreaching position (Position B in FIG. 10) as the lift arm 40 moves toward the load level. The first controlling mechanism 52 also automatically moves the pick-up arm 32 sequentially into the close-in position (Position $\bar{A}$ in FIG. 10) as the lift arm 40 moves toward the off-load level. As shown in FIGS. 2 and 3, the pick-up arm 32 is moved from its outreaching position into the close-in position preferably by the time the pick-up arm 32 has reached the top of the cab 14.

The first controlling mechanism 52 is preferably actuated by the operator using a single control level 54 (see FIG. 1) situated in the cab 14. The driver can thus both raise and lower the lift arm 40 and position the pick-up arm 32 in either loading or off-loading operations with the single control lever 54.

In the illustrated and preferred embodiment, the first actuating mechanism 48 includes means (see FIGS. 11*a*, 11*b* and 11*c*) for automatically controlling the speed at which the pick-up arm moves between its close-in and outreaching positions. More particularly, the speed control means 56 increases the velocity of the pick-up arm 32 as it moves from the outreaching position toward the close-in position, until a desired intermediate position is reached (shown in phantom line Position C in FIG. 10). The speed control means 56 then automatically decreases the velocity of the pick-up arm 32 as it moves from the intermediate position toward the close-in position. Likewise, the speed control means 56 is further operative for automatically increasing the velocity of the pick-up arm 32 as it moves from the close-in position toward the intermediate position, and then decreasing the velocity as the pick-up arm 32 moves from the intermediate position toward the outreaching position. Optimal control of pick-up arm movement when it is either close to the ground or close to the cab is thereby achieved.

In the illustrated and preferred embodiment, and as will be described in greater detail later, the first controlling mechanism 52 can be selectively disabled by the operator to maintain the pick-up arm 32 in its close-in position during movement of the lift arm 40 between its load and off-load levels. The apparatus 28 is thereby readily adaptable to the situation where the collection container 30 is to be engaged in front of the cab.

The apparatus 28 further includes a third actuating mechanism 58 (FIGS. 1–4, 9–10) that pivots the pick-up arm 32 relative to the front lift arm leg 33 about an axis 60 that is generally parallel to the ground (see FIGS. 1 and 10). This pivotal movement serves to move the pick-up arm 32 between a load position (see FIGS. 2 and 3) holding the engaged container 30 generally vertical relative to the ground and an off-load position (see FIGS. 4 and 5) holding the engaged containers 30 in a tipped relationship relative to the ground. As shown in FIG. 5, when the lift arm 40 is situated in its off-load level with the pick-up arm 32 in its close-in and off-load position, the contents of the engaged containers are dumped by gravity into the container 20 through the opening 22.

The apparatus 28 includes a second controlling means 62 (FIGS. 6–10) interconnecting the second and third actuating mechanisms 50 and 58, to thereby coordinate pivotal movement of the pick-up arm 32 about the axis 60 with the up and down movement of the lift arm 40. More particularly, as shown in FIGS. 2 and 3, the second controlling mechanism 62 automatically maintains the pick-up arm 32 in its load position as the lift arm 40 moves between its load level and a predetermined level above the ground. In the illustrated embodiment, the predetermined level is just above the front window of the cab 14 (see FIG. 3).

The second controlling mechanism 62 thus serves to hold the engaged container 30 generally vertical to the ground until the top of the cab 14 is cleared. Spillage of waste materials in front of the cab 14 is thereby avoided as the lift arm 40 is raised.

The second controlling mechanism 62 also preferably serves to coordinate movement of the pick-up arm 32 into its off-load position. Thus, as shown in FIGS. 4 and 5, as the engaged containers 30 are brought close to the inlet opening 22, they are successively tipped to dump their contents into the container 20. A dump shield 146 is provided to protect the top of the cab 14 from materials accidentally spilled from the container 30.

In the illustrated preferred embodiment, the second controlling mechanism 62 is actuated by the same single control lever 54 as the first controlling mechanism 52. Thus, all the desired relative movement of the lift arm 40 and pickup arm 32 is coordinated using the single control 54.

Figure 9:
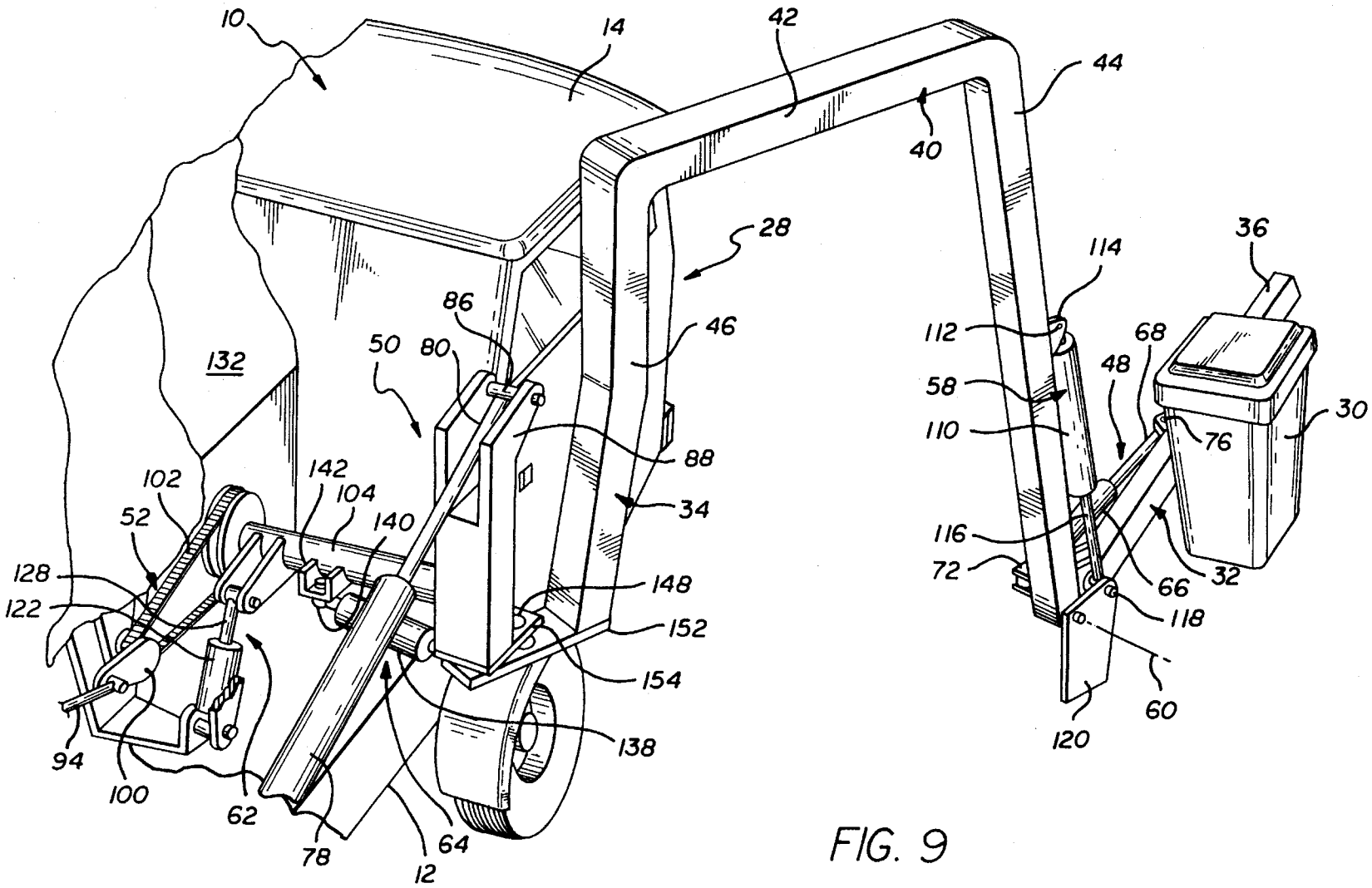
FIG. 9 is a perspective view of the vehicle shown in FIG. 1, looking forward from a raised vantage point, showing the lateral side movement of the lifting and loading assembly.

As shown in FIGS. 9 and 10, for the situation where the collection containers 30 are spaced off the right hand side of the cab 14, the apparatus 28 includes a fourth actuating mechanism 64 for moving the lift arm 40 about a pivot axle 148 between a normal first position next to the cab 14 (shown in solid line Position B in FIG. 10), and a second position angularly spaced off to the side of the cab 14 (shown in FIG. 9 and as phantom Position D in FIG. 10).

Preferably, the fourth actuating mechanism 64 is controlled by the same, heretofore described control lever 54. Thus, by moving the control lever 54 fore and aft, the lift arm 40 can be raised and lowered, together with the automatically coordinated movement of the pick-up arm 32. By moving the control level 54 to the side, the lift arm 40 can be moved sideways between its first and second positions shown in FIGS. 9 and 10.

While the various actuating and control mechanisms for the apparatus 28 can be variously constructed, in the illustrated and preferred embodiment, the mechanisms are actuated by fluid hydraulic pressure.

In this arrangement, the first actuating mechanism 48 takes the form of a hydraulic cylinder 66 that controls a piston rod 68. As shown in FIG. 10, the cylinder 66 is pivotally attached by a pin 70 to a bracket 72 on the front lift arm leg 44. The piston rod 68 is likewise pivotally attached by a pin 74 to a bracket 76 on the pick-up arm 32. Extension of the piston rod 68 in response to hydraulic fluid introduced into the base end of the cylinder 66 moves the pick-up arm 32 toward its outreaching position (Position B in FIG. 10). Likewise, retraction of the piston rod 68 in response to hydraulic fluid introduced into the piston end of the cylinder 66 moves the pick-up arm 32 to the close-in position (Position A in FIG. 10).

Also in this arrangement, as shown in FIGS. 1 and 10, the second actuating mechanism 50 takes the form of another conventional hydraulic cylinder 78 controlling a piston rod 80. The cylinder 78 is pivotally attached by a pin 82 to a bracket 84 extending below the frame 12. The piston rod 86 is likewise pivotally attached by a pin 86 to a bracket 88 extending from the plate 154. As shown in FIGS. 3 to 5, retraction of the piston rod 80 by the introduction of hydraulic fluid into the piston rod end of the cylinder 78 serves to tilt the rear lift leg 46 about the axle 104, to thereby raise the lift arm 40 toward its off-load level. Conversely, extension of the piston rod by the introduction of hydraulic fluid into the base end of the cylinder serves to tilt the lift arm 40 toward its load level.

Figure 6:
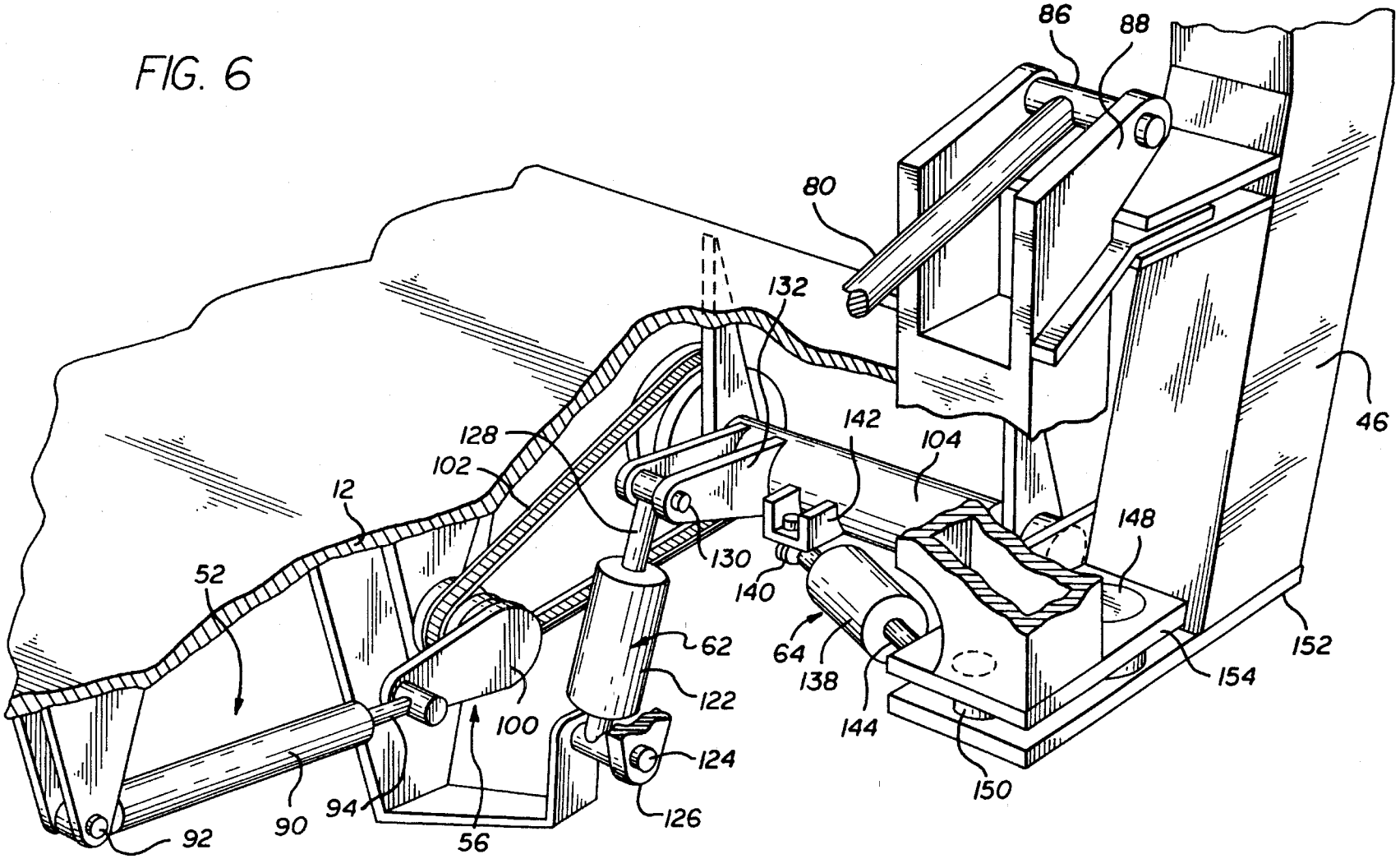
FIGS. 6 to 8 are enlarged perspective views of a portion of the control mechanism for the lifting and loading assembly shown in FIG. 1, with portions broken away, showing the sequential operation and interrelationship of various control elements that embody the features of the invention.
Figure 7:
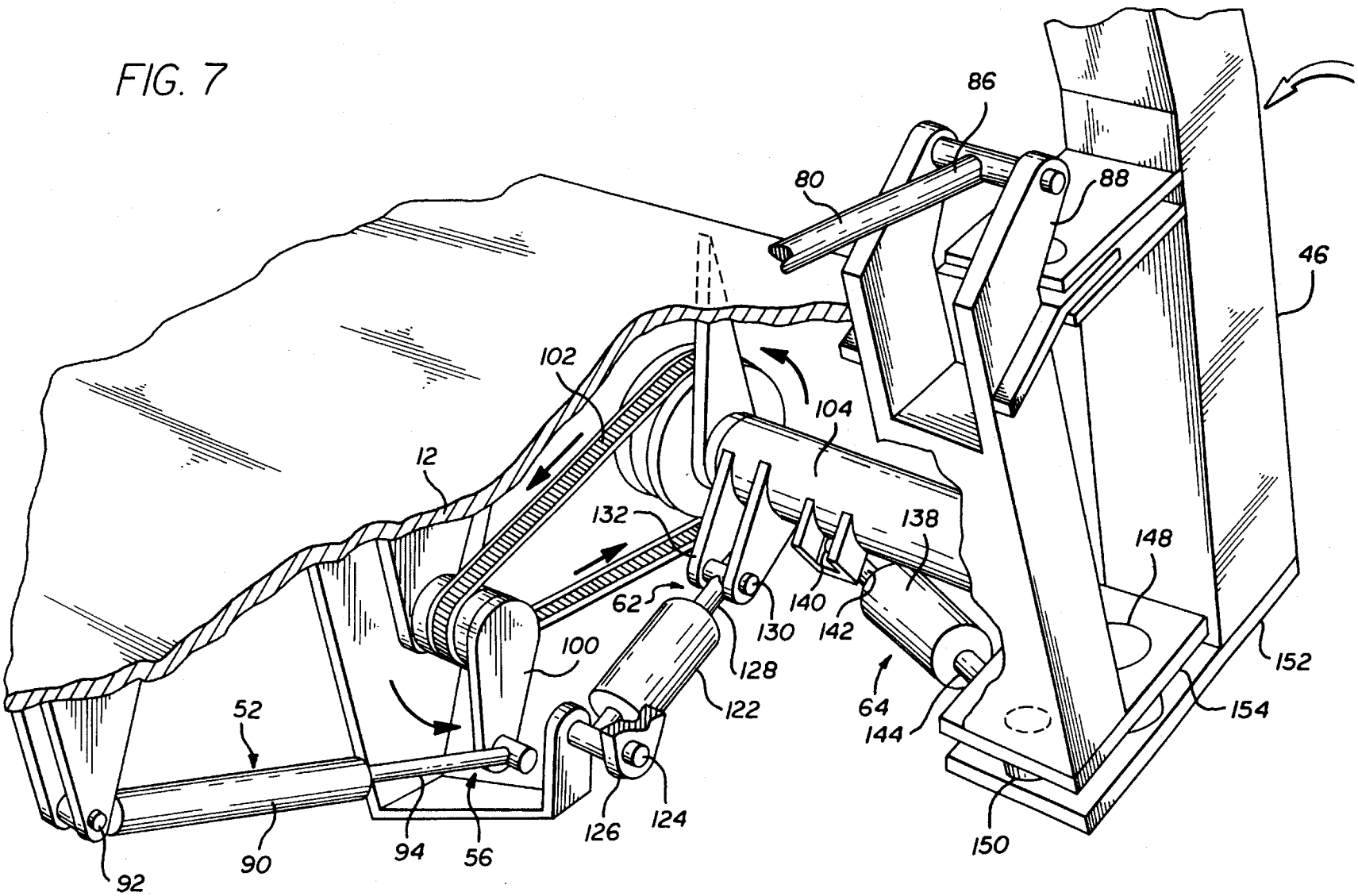
Figure 8:
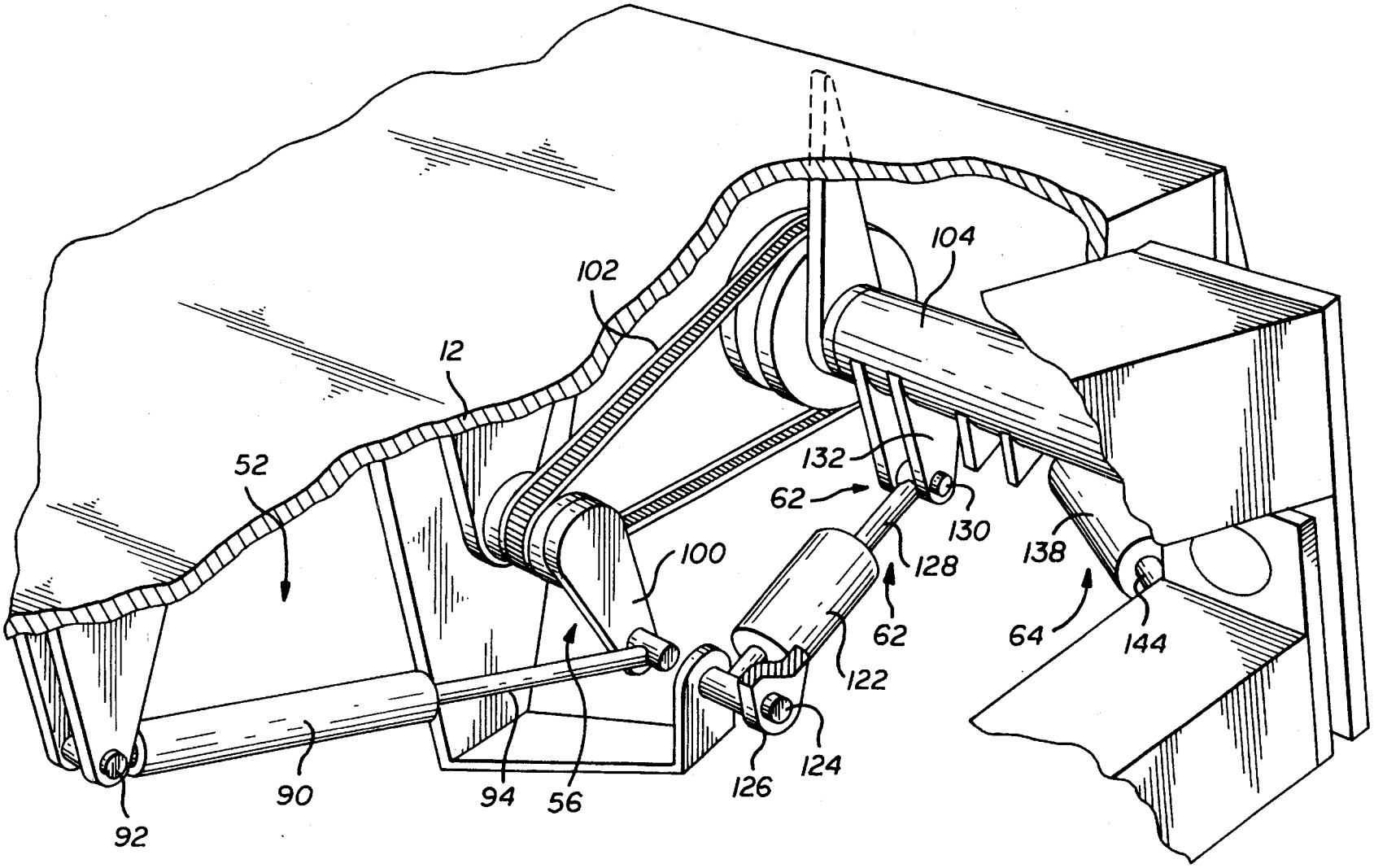
Figure 11A:
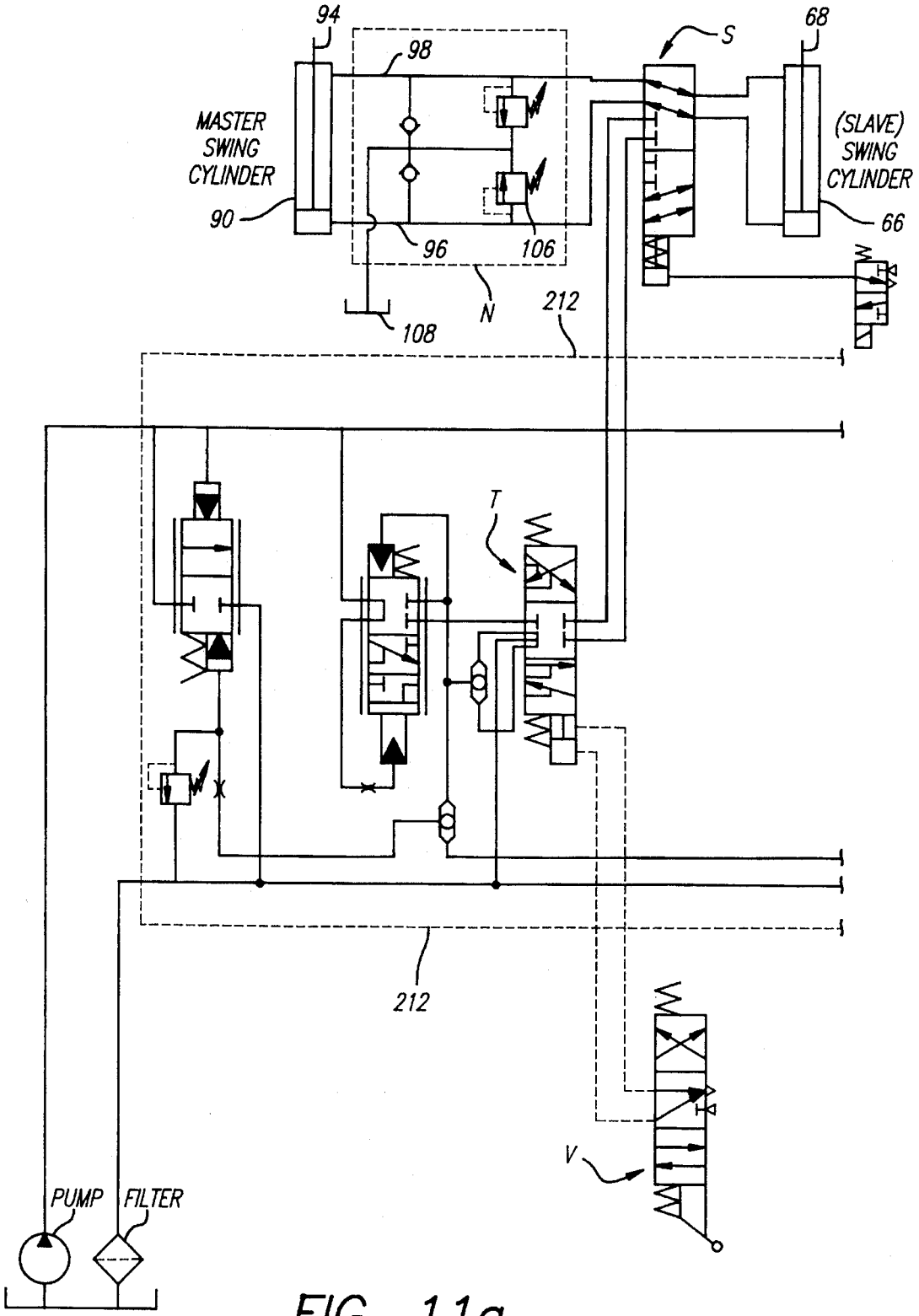
FIGS. 11(*a*), 11(*b*) and 11(*c*) are schematic views of a fluid pressure control circuit for the lifting and loading assembly vehicle the vehicle in FIGS. 1–10 incorporates.

In this arrangement, the first controlling mechanism 52 takes the form of a conventional hydraulic cylinder 90 (FIGS. 2–4, 10) pivotally attached by a pin 92 to the frame 12. The cylinder 90 has a piston rod 94. The cylinder 90 is connected with the cylinder 66 in a master-slave relationship, in which the cylinder 90 is the master and the cylinder 66 is the slave. More particularly, as shown in FIG. 11*a*, a conduit 96 (See FIG. 11*a*) connects the base end of the master cylinder 90 with the base end of the slave cylinder 66. Another conduit 98 connects the piston rod end of the master cylinder 90 with the piston rod end of the slave cylinder 66. As best shown in FIGS. 6 to 8, the master piston rod 94 is moved into and out of the master cylinder 90 by a bell crank 100 that is operatively connected by a chain drive 102 to the tilt axle 104. As before described, up and down movement of the lift arm 40 in response to the cylinder 78 rotates the tilt axle 104.

More particularly, as the lift arm 40 is moved toward its off-load position (by retraction of the piston rod 80), the tilt axle 104 and chain drive 102 rotate counterclockwise (see FIG. 7). This in turn rotates the bell crank 100 counterclockwise.

As shown in FIGS. 6 to 8, the rotating bell crank 100 pulls the master piston rod 94 successively out of the master cylinder 90. Hydraulic fluid is displaced from the piston rod end of the master cylinder 90 via a conduit 98 (See FIG. 11*a*) into the piston rod end of the slave cylinder 66. The slave piston rod 68 is thereby moved into the slave cylinder 66.

As shown in FIG. 10, the pick-up arm 32 is thereby automatically moved from its outreaching position toward its close-in position as the lift arm 40 is moved upwardly from its load level. The slave piston rod 68 reaches its fully retracted position (shown in phantom position A in FIG. 10), maintaining the pick-up arm 32 in its close-in position, as the lift arm 40 reaches the predetermined above cab height level (shown in FIG. 3).

Subsequent downward movement of the lift arm 40 from the above cab height level (shown in FIG. 3) back toward the load level (by the extension of the piston rod 80) serves to rotate the tilt axle 104 and chain drive 102 in the opposite direction, or clockwise. The bell crank 100 is thereby rotated clockwise, pushing the master piston rod 94 into the master cylinder 90. Hydraulic fluid is displaced from the base end of the master cylinder 90 via the conduit 96 into the base end of the slave cylinder 66. The slave piston rod 68 is thereby moved out of the slave cylinder 66, moving the pick-up arm 32 back toward its outreaching position. The slave piston rod 68 reaches its fully extended position, maintaining the pick-up arm in its outreaching position (position B in FIG. 10), as the lift arm 40 reaches the load position. Movement of the pick-up arm 32 into its outreaching position is thereby automatically coordinated with the lowering of the lift arm 40 to its load level.

The speed control means 56 previously described is achieved in this arrangement by virtue of the mechanical advantage between the bell crank 100 and the master piston rod 94, which varies with the rotational position of the bell crank 100. The velocity at which the pick-up arm 32 is moved also thereby varies. More particularly, as the bell crank 100 successively moves counterclockwise from the position shown in FIG. 6, pulling the piston rod 94 out of the cylinder 90, the mechanical advantage successively increases until the bell crank 100 reaches the rotational position shown in FIG. 7. This imparts increasing velocity to the movement of the pick-up arm 32 as it moves from its outreaching position (Position A in FIG. 10) to an intermediate position (Position C in FIG. 10). The mechanical advantage successively decreases as the bell crank 100 moves out of the FIG. 7 position toward the position shown in FIG. 8. This imparts decreasing velocity to the movement of the pick-up arm 32 as it moves from the intermediate position (Position C in FIG. 10) to its close in position (Position A in FIG. 10).

As shown in FIG. 11*a*, a two-way control valve 106 located in the conduit 96 selectively directs hydraulic fluid either to the base end of the slave cylinder 66, to automatically move the pick-up arm 32 to its outreaching position as above described, or to the sump 108. When fluid is directed to the sump 108, the interconnection between the first and second activating mechanisms 48 and 50 is disabled. The pick-up arm 32 is maintained in its close-in position as the lift arm 40 is raised and lowered.

The third actuating mechanism 58 takes the form of another conventional hydraulic cylinder 110 attached by a pin 112 to a bracket 114 on the front lift arm leg 44 (see FIG. 2). The cylinder 110 includes a piston rod 116 attached by a pin 118 to a bracket 120 on the pick-up arm 32. As shown in FIGS. 3 to 5, extension of the piston rod 80 by the introduction of hydraulic fluid into the base end of the cylinder 78 rotates the bracket 120 clockwise, and vice versa.

In this arrangement, the second controlling mechanism 62 takes the form of a cylinder 122 attached by a pin 124 to a bracket 126 extending below the frame 112. The cylinder 122 includes a piston rod 128 that is attached by a pin 130 to a bell crank 132 attached to the tilt axle 104. As can be seen in FIGS. 6 to 8, rotation of the tilt axle 104 rotates the bell crank 132 to impart movement to the piston rod 128.

Figure 12:
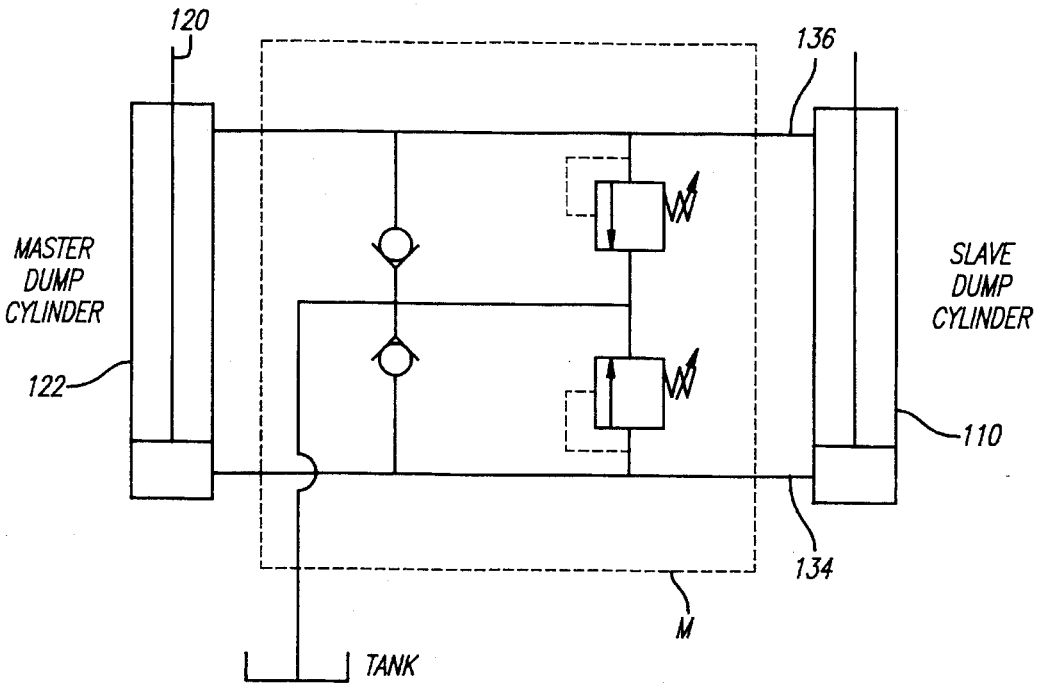
FIG. 12 shows an additional fluid pressure control circuit for providing a closed loop between a master dump cylinder and a slave dump cylinder.

The cylinder 122 is connected with the cylinder 110 in a master-slave relationship, in which the cylinder 122 is the master cylinder and the cylinder 110 is the slave cylinder. As shown in FIG. 12, a conduit 134 connects the base ends of the cylinders 110 and 122, and a conduit 136 connects the piston rod ends of the cylinders 110 and 122.

As shown in FIGS. 6 and 7, as the lift arm 40 is moved upwardly from its load level (by the cylinder 78), the counterclockwise movement of the tilt axle 104 and bell crank 132 at first pushes the master piston rod 128 into the cylinder 122. Hydraulic fluid is displaced via the conduit 134 from the base end of the master cylinder 122 to the base end of the slave cylinder 110. The slave piston rod 116 extends, pivoting the pick-up arm 32 clockwise about the horizontal axis 60.

The clockwise pivoting of the pick-up arm 32 as the lift arm 40 is raised, serves to automatically maintain the engaged containers in the desired vertical relationship with the ground, until the pick-up arm 32 reaches the desired height above the cab (see FIG. 3).

As shown in FIGS. 7 and 8, as the lift arm 40 is subsequently raised higher toward the off-load position, continued counterclockwise rotation of the bell crank 132 begins to pull the master piston rod 128 out of the master cylinder 122. Hydraulic fluid is displaced via the conduit 136 from the piston rod end of the master cylinder 122 to the piston rod end of the slave cylinder 110. The slave piston rod 116 retracts, pivoting the pick-up arm 32 counterclockwise about the horizontal axis 60.

The counterclockwise pivoting of the pick-up arm 32 as the lift arm 40 moves from the above-cab level (FIG. 3) toward the off-load position (FIGS. 4 and 5) serves to automatically tip the engaged containers 30 into the desired relationship with the inlet opening 22 to facilitate dumping when the off-load level is reached.

Conversely, as the lift arm 40 is lowered from the off-load level (by extending the piston rod 80), the now clockwise rotation imparted to the bell crank 132 first pushes the master piston rod 128 into the master cylinder 124. Hydraulic fluid displaced from the base end of the master cylinder 124 is conveyed via the conduit 134 into the base end of the slave cylinder 110. The slave piston rod 116 is extended outwardly. The pick-up arm 32 is pivoted clockwise, and the engaged containers 30 are thereby moved from their tipped condition back toward the desired vertical relationship with the ground. This vertical relationship is reached as the lift arm 40 reaches the above cab level height shown in FIG. 3.

With the subsequent lowering of the lift arm 40 toward the load level (FIG. 2), the bell crank 132 pulls the master piston rod 128 out of the master cylinder 122. Hydraulic fluid conveyed via the conduit 136 from the piston rod end of the master cylinder 122 into the piston rod end of the slave cylinder 110 retracts the slave piston rod 116. The pick-up arm 32 is pivoted counterclockwise to maintain the engaged containers 30 in the desired vertical relationship.

In the illustrated arrangement, as shown in FIGS. 7 to 10, the fourth actuating mechanism 64 takes the form of another conventional hydraulic cylinder 138 pivotally attached by a pin 140 to a bracket 142 carried by the tilt axle 104. The cylinder 138 controls a piston rod 144 which is attached by a pin 150 to the plate 142. Retraction of the piston rod 144 serves to pivot the lift arm 40 into its second position (see FIG. 9), and vice versa.

FRONT-SIDE LIFT CIRCUIT EXPLANATION

The normal operation of the lift is explained first. Second, any alternative or anomalous operations that may occur are addressed and the corresponding safety measures detailed. Third, any unique features are identified.

Figure 11B:
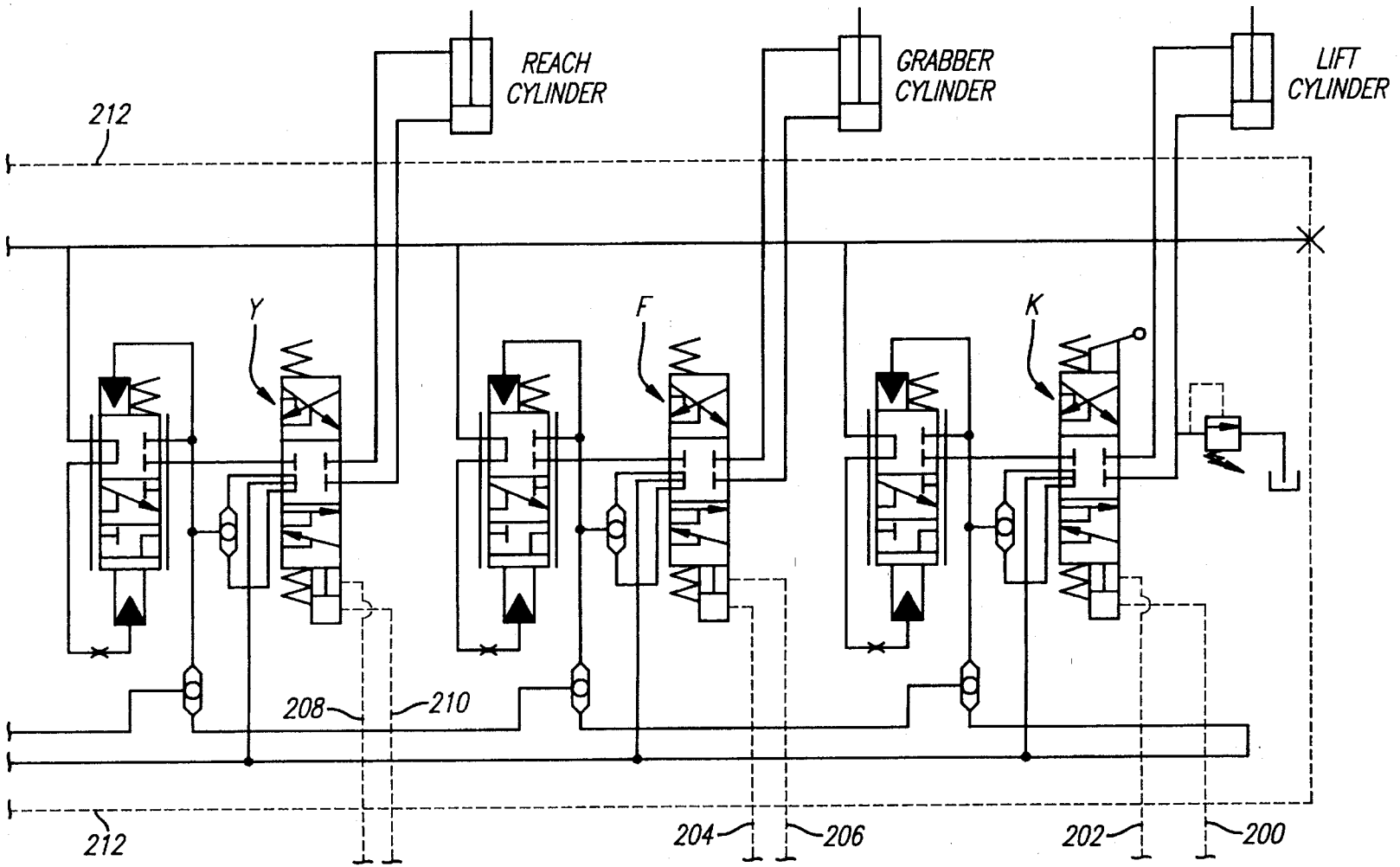
Figure 11C:
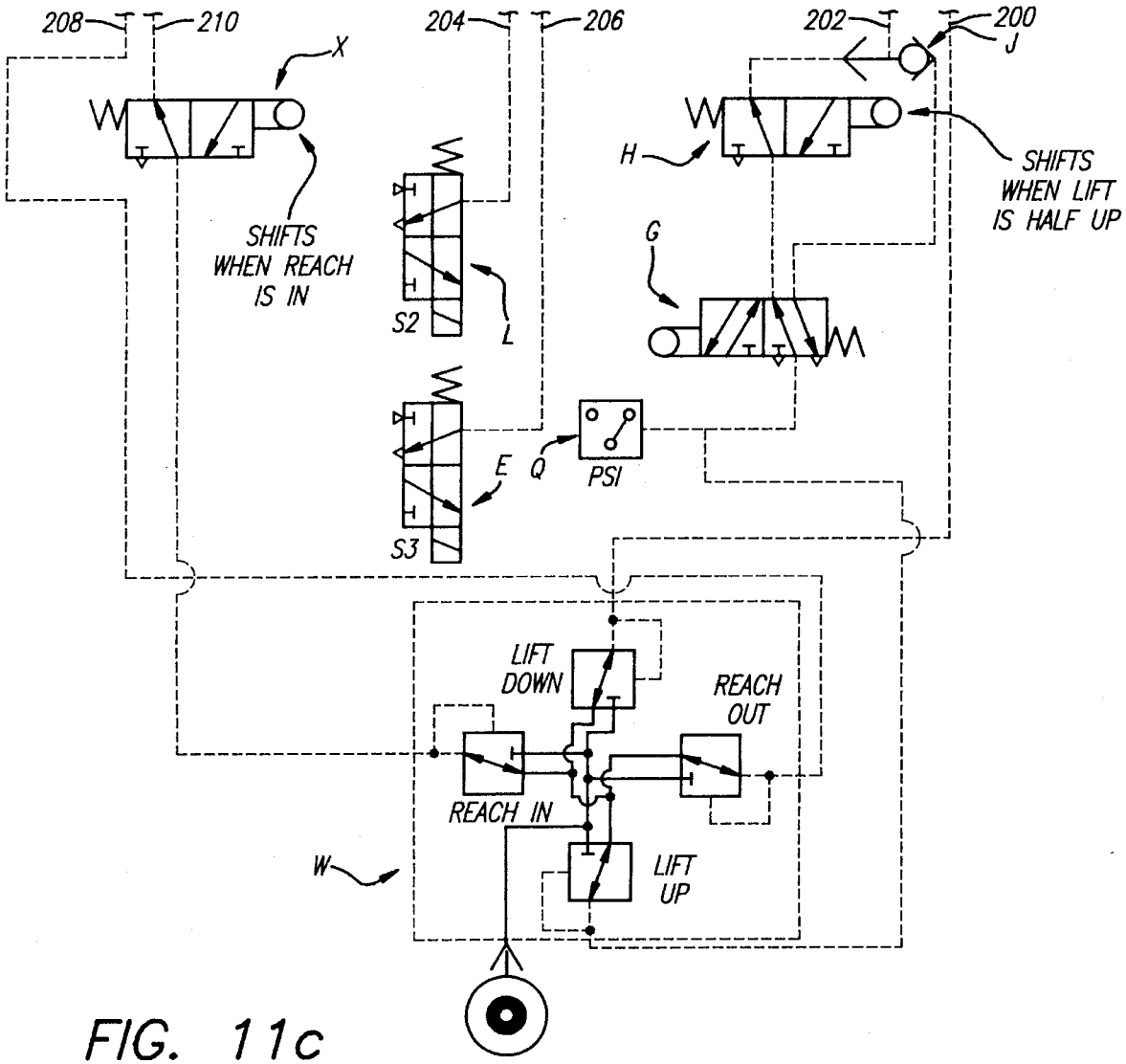

FIGS. 11*a*, 11*b* and 11*c* show portions of a complete hydraulic circuit. Broken lines 200, 202, 204, 206, 208 and 210 connect FIGS. 11*b* and 11*c*. A broken rectangle 212 connects FIGS. 11*a* and 11*b*.

NORMAL OPERATION

The operator drives the vehicle 10 to a container 30 (FIG. 1). If the container 30 is too far away for the operator to drive the vehicle 10 directly to the container 30, the operator moves the pneumatic joystick or lever W in FIG. 11*c* to the right. The joystick A in FIG. 11*c* corresponds to the lever 54 in FIG. 1. This allows air pressure to be provided into the rod end of the actuator for a reach cylinder valve Y in FIG. 11*b*. Valve Y shifts. Oil from the pump in FIG. 11*a* flows into the head end of the Reach Cylinder in FIG. 11*b*. This swings the lift arm 40 outwardly to the position shown in FIG. 10. When the grabbers or gripping members 38 in FIG. 2 are close to the storage container 30, the operator returns the joystick W to the center position. This vents the head end of the actuator of the valve Y in FIG. 11*b* and the springs in the valve return the actuator to the center position, thereby discontinuing oil flow to the Reach Cylinder.

Figure 13:
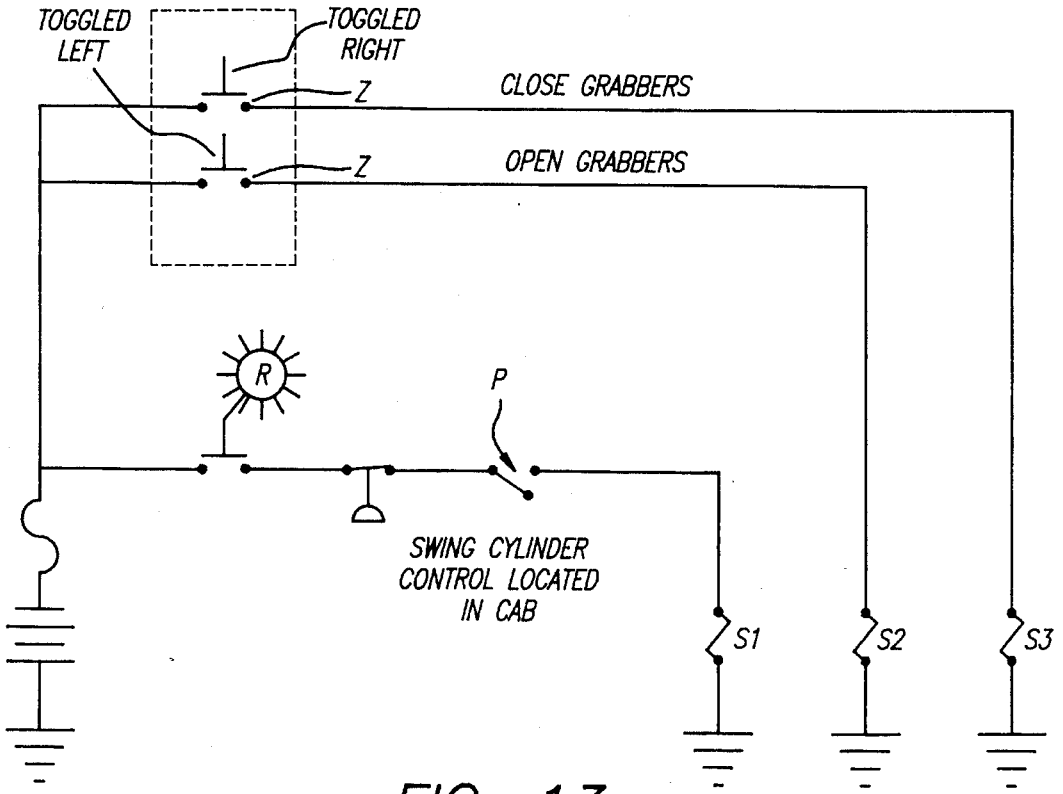
FIG. 13 is a schematic circuit diagram of an electrical circuit for controlling the operation of the fluid pressure control circuits shown in FIGS. 11 and 12.

The operator pushes the toggle right switch (FIG. 13) located on the top of the joystick W. This energizes a solenoid S3 in the electrical circuit (FIG. 13). The solenoid S3 shifts a valve E in FIG. 11*c*. Air pressure is allowed into the rod end of the actuator for a grabber valve F as indicated by the broken line 206 extending between the valves E in FIG. 11*c* and F in FIG. 116. The grabber valve F shifts such that oil flows into the head end of the grabber cylinder, closing the grabbers 38. The operator deactivates the toggle switch in FIG. 13 and the spring in the valve F in FIG. 116 returns the valve to neutral.

The operator now pulls the joystick W in FIG. 11*c* back and to his left. This allows air pressure into 2 places, the reach in and lift up portion of the joystick circuit. The 'reach in' air pressure passes through a reach position sensing valve X in FIG. 11*c* to the base end of the actuator for the reach cylinder valve Y in FIG. 11*b*. The air for lifting the lift arm 40 passes through a reach position sensing valve G in FIG. 11*c*, through a lift position sensing valve H in FIG. 11*c* and through a shuttle valve J in FIG. 11*c* into the rod end of the actuator for a lift cylinder valve K in FIG. 11*b*. Oil flows through the Reach Cylinder valve Y to the rod end of the reach cylinder and the lift arms 40 begin to swing into the position D in FIG. 10. Oil also flows through the lift cylinder valve K in FIG. 11*b* and into the base end of the lift cylinder 78 (FIGS. 6–7). The lift arm 40 begins to rise.

During the raising and lowering of the lift arm 40, two master-slave cylinder circuits operate. They are 1) a grabber arm dump circuit M in FIG. 12, and 2) a grabber arm swing in - out circuit N in FIG. 11*a*. They operate as described below.

THE GRABBER ARM DUMP CIRCUIT M (FIG. 12)

The master dump cylinder in FIG. 11*a* is driven by two ears that extend from the lift arm cross-shaft. These ears drive the master dump cylinder 122 in and out relative to the rotation of the main arm. The master dump cylinder 122 is extended as the lift arm 40 rises. An ⅛" extra stroke on the master dump cylinder 122 insures that the master and slave dump cylinders 122 and 110 remain synchronous in cycle after cycle. The oil from the ⅛" extra stroke of the master cylinder 122 flows over the cross port relief valve (216) to tank, and the other end of the master cylinder sucks oil from the tank. The slave dump cylinder 110 controls the grabber arm 38 dump motion. As the lift arm 40 begins to lift the container 30, the master cylinder 122 contracts. This extends the slave cylinder 110 keeping the grabber arm 38 level as the lift arm 40 continues to lift the container 38. Once the ears of the master cylinder 122 have crossed over center, the master cylinder begins to extend.

THE GRABBER ARM SWING IN - OUT CIRCUIT N (FIG. 11*a*)

The master swing cylinder 90 in FIG. 11*a* is driven by two ears that extend from the main arm 40. These ears drive the master swing cylinder 90 in and out relative to the rotation of the main arm 40. The master swing cylinder 90 is extended as the lift arm 40 raises the container 30. There is an ⅛" extra stroke on the master swing cylinder 90. This insures that the master and slave swing cylinders 90 and 66 remain synchronous cycle after cycle. The oil from the ⅛" extra stroke of the master cylinder 90 flows over the relief valve to tank and the other end of the master cylinder 90 sucks oil from the tank through the check valve. The slave cylinder 66 controls the grabber arm 38 swing in - out motion. At full extension of the slave cylinder 66, the grabber arm 38 is fully swung into the close-in position.

One additional note. The swing in - out cylinder circuit has two additional valves. These will be discussed later under alternate operating modes. Throughout the remainder of this explanation, it will be presumed that these two circuits are acting in accordance with the above description unless otherwise noted.

If the joystick or lever 54 (or W in FIG. 11*c*) is in the lower left quadrant as seen in FIG. 11*c*, the reach cylinder fully retracts at approximately the same time as the lift arm 40 is half way up (considered to be 30°).

Both the reach position sensing valve G in FIG. 11*c* and the lift position sensing valve K in FIG. 11*b* shift as the pick-up arm 32 moves completely in to the close-in position and is half way up toward the off-load position. The air pressure now goes through lift position sensing valve G in FIG. 11*c* and bypasses reach sensing valve H in FIG. 11*c*. Shuttle valve J in FIG. 11*c* now shifts and air pressure continues to the rod end of the actuator for the lift cylinder valve K in FIG. 11*b*. Oil continues to flow into the base end of the lift cylinder 90 in FIG. 11*a*. The lift arm 40 continues to rise until the container 30 is in the fully dumped position. At this time, the manual control lever on the lift cylinder valve K becomes actuated to return the valve to the neutral position. The lift arm 40 stops.

When the contents of the container 30 are dumped into the storage container, the operator moves the joystick W into the up position in FIG. 11*c*. This allows air pressure to be provided into the base end of the actuator for the lift cylinder valve K in FIG. 11*b*. The valve K shifts, allowing oil to flow into the rod end of the lift cylinder 90 in FIG. 11*a*. The lift arm 40 begins to move downwardly. Once the lift arm 40 is more than half way down, the operator moves the joystick into the forward right position in FIG. 11*c*. The lift arm 40 continues to move downwardly and air pressure now goes into the rod end of the actuator for the reach cylinder valve Y in FIG. 11*b*. The valve C shifts, allowing oil to flow into the base end of the reach cylinder. The pick-up arm 32 begins to move outwardly. By adjusting the extent to which the operator moves the joystick W to the right position, he can determine how far out the reach cylinder moves the lift. An experienced operator can return the container to its original position quite easily.

After the container 30 has been returned to the desired position, the operator moves the joystick W in FIG. 11*c* to the neutral position and activates the toggle switch (FIG. 13) on top of the joystick. This energizes the solenoid S2 which shifts a valve L in FIG. 11*c*. This allows air pressure to be introduced into the base end of the actuator for the cylinder valve F (FIG. 11*b*) of the grabber 38. The valve F shifts and oil flows into the rod end of the grabber 38 cylinder and the grabbers 38 (FIG. 2) open. The operator moves the joystick W to the left and air under pressure flows through the reach position sensing valve X in FIG. 11*c* and into the base end of the actuator for the reach cylinder valve Y in FIG. 11*b*. The valve Y shifts, allowing oil to flow into the rod end of the reach cylinder. The lift moves in. When the lift is fully reached in, reach position sensing valve (B) shifts cutting off air pressure to the actuator for the reach cylinder valve (C). The spring centered valve returns to center and the oil flows to the tank.

ALTERNATE OPERATIONS

The most common operation of the Front - Side lift is explained above. There are a few deviations that are available but are not used as frequently. They are as follows:

Sometimes all the refuse does not fall out of the container 30 when the container is lifted to transfer the refuse into the storage container 20 through the inlet 22. When this happens, the operator would desirably jerk the container 30 at the top of the dump cycle. The operator can accomplish this by doing the following:

The joystick W in FIG. 11*c* is moved back and forth between the forward and rear positions. By moving the joystick W forwardly, air under pressure flows into the rod end of the actuator for the lift cylinder valve K in FIG. 11*b*. This valve shifts, allowing oil to flow into the rod end of the lift cylinder (K). The lift arm 40 begins to move downwardly. By moving the joystick W to the rear, air pressure passes through the lift position sensing valve G in FIG. 11*c* into the rod end of the actuator for the lift cylinder valve K. The valve K shifts, allowing oil to flow into the base end of the lift cylinder 90 and the lift arm 40 rises to the dumped position. Again, the manual control lever on the lift cylinder valve K becomes actuated, returning the valve to the neutral position. The lift arm 40 stops at the top of its stroke. The operator can repeat this cycle until all the refuse has fallen out of the container 30.

One benefit of the lift arrangement described above is the ability to pick up containers 30 from 1) the side of the track, (2) in front of the truck, or 3) anywhere in between. The first option has been explained above. The description of the two other options follows.

First, located in the cab is a switch P (FIG. 13). When the operator wants to swing the grabber arm 38 inwardly and outwardly manually, he initially activates the switch P. This energizes solenoid S1 (FIG. 13) which shifts air valve R. This allows air under pressure to be provided into the base end of the actuator for swing cylinder valve S in FIG. 11*a*.

The valve S shifts and transfers control of the swing in-out cylinder 66 from the master swing in out cylinder 90 to the swing in - out control valve T in FIG. 11*a*. The valve T is controlled by a manual control valve V in FIG. 11*a*. This allows the operator to manually position the grabber arm in any position he needs or desires to access the container 30. The operator now toggles the toggle right switch (FIG. 12) on top of the joystick W and the grabbers 38 close on the container 30. The operator now moves the joystick W into the bottom position in FIG. 11*c* and the lift begins the dump motion described above.

ANOMALOUS OPERATIONS

Three (3) anomalies to the normal operation of the Front - Side lift are as follows:

1) The operator can attempt to dump the container 30 while the lift arm 40 is in a reached-out position. As a precaution, the reach position sensing valve G in FIG. 11*c* and the lift position sensing valve K in FIG. 11*b* operate in concert to assure that the operator cannot fully dump the container 30 with the lift arm 40 not fully retracted. This ensures that the contents of the container 30 are not dumped on anything that is to the rear of such container.

With proper operation of the lift arm 40, the operator will move the joystick W to the bottom and left quadrant shown in FIG. 11*c*. This will cause the lift to raise and move in together. If the operator chooses to move the joystick W only to the bottom position in FIG. 11*c*, air under pressure will pass to the rod end of the actuator for the lift cylinder valve K in FIG. 11*b*. This valve shifts and the lift arm 40 begins to rise. Because the operator has not moved the joystick W to the left in FIG. 11, the lift arm will remain reached out. Once the lift arm reaches half way up (presumed to be 30°), the lift position sensing valve H in FIG. 11*c* shifts, cutting off air pressure to the actuator for the lift cylinder valve K. The lift arm 40 will not continue to lift the container 30. At this point, the operator can move the joystick W to the left, causing the pick-up arm 32 to move fully inwardly. Once the lift arm 40 is fully moved in the reach position, sensing valve G in FIG. 11*c* shifts, causing the air under pressure to bypass the lift position sensing valve H in FIG. 11*c*. The operator now can move the joystick W to the bottom, causing the lift arm 40 to move upwardly.

2) If the operator moves the joystick W to the rear and slightly to the left, the lift arm 40 will begin to move upwardly and move inwardly. Under this scenario, air pressure for continuing the lift process passes through the reach position sensing valve G in FIG. 11*c* and the lift position sensing valve H. If the lift arm 40 reaches the half-way-up position (presumed to be 30°) before the lift arm is fully moved inwardly, the lift position sensing valve (H) shifts, cutting of air pressure to the actuator for the lift cylinder valve K in FIG. 11*b*. The lift arm will not continue to move upwardly. However, because the joystick W is slightly to the left of the neutral position in FIG. 11*c*, air under pressure will continue to flow to the base end of the actuator for the reach cylinder valve Y in FIG. 11*b*. Oil will continue to flow to the rod end of the reach cylinder and the lift arm 40 will continue to move inwardly. The operator may choose to move the joystick W fully to the left in FIG. 11*c*. This would reduce the time required to move the lift arm 40 fully inwardly. Once the lift arm 40 is fully moved inwardly, the reach position sensing valve G in FIG. 11*c* shifts, causing air pressure to bypass the lift position sensing valve H in FIG. 11*c*. The operator now can move the joystick W to the bottom position in FIG. 11*c*, causing the lift arm 40 to move upwardly.

3) Under manual operation to swing the grabber arm 38 inwardly or outwardly, the operator can begin to dump the container 30 while the grabber arm is fully swung out. As a precaution, a safety switch Q in FIG. 11*c* is activated whenever the joystick Q is disposed in the position to lift the lift arm 40. Air under pressure opens the switch Q which de-energizes a solenoid S1. This returns control of the grabber arm 38 swing-in to the master - slave circuit defined by the master cylinder 90 and the slave cylinder 66 in FIG. 11*a*. Once the refuse in the container 30 is dumped into the container 20 and the operator moves the joystick W into the position to move the lift arm 40 downwardly, the switch Q closes and returns control of the grabber arm 38 swing in out to the manual control valve Q. This allows the operator to reposition the container 30 at the position where the operator picked up the container.

This is quite valuable. When picking up containers 30 in a cul-de-sac, a significant amount of time is saved if the operator can position the grabber arm in any position rather than be forced to position the entire truck to access the containers. Also, there may be objects that obstruct the direct access to a container 30. Through the combination of the reach and grabber arm 38 positioning, the operator has enhanced flexibility in accomplishing his job.

UNIQUE FEATURES

Because of the pressure compensated flow control valve (2), the volume of oil flow through each section of the valve is possible. This volume can be modified on-site. Thus, each truck can be optimized for maximum efficiency and performance.

The pressure compensation feature ensures that oil will flow to all sections regardless of individual loading. An example of this feature follows:

If the operator has to swing the lift arm 40 outwardly to retrieve a container 30, he will also want to both lift and swing the lift arm at the same time. The force (and the pressure) required to lift the container 30 is greater than that required to swing the arm inwardly. If pressure compensation is not available, all of the flow would be to the section of least resistance, i.e. the swing - in section. The lift arm 40 would swing inwardly until the swing - in cylinder was fully collapsed. Then the pressure would rise in the swing - in section sufficiently to force oil into the lift circuit. This is undesirable. Pressure compensation insures that, in this situation, oil will flow to both sections simultaneously. The lift arm 40 will swing inwardly and lift at the same time. This cuts down the cycle time considerably.

One problem that the lift arms in refuse equipment now on the market are experiencing is the production of high forces at the end of the dump cycle due to rapid deceleration. These high forces are well in excess of the static loading applied once the lift arm has come to a stop at the top. The lift cylinder valve K in FIG. 11*b* has a cam actuator opposite the air actuator. This valve is mounted such that this valve is returned to center at the top of the dump cycle. The cam begins to actuate prior to the end of the dump cycle. As the lift arm 40 continues to rise toward the end of the cycle, the cam gradually shifts the lift cylinder valve inwardly toward a center position. This is a gradual process and causes a gentle deceleration of the dump motion of the lift arm 40 and the container 30 at the top of the lift arm movement. This causes the container 30 to decelerate slowly and thus reduce the deceleration forces at the top. Even when the master - slave dump circuit is replaced with a linkage, the gradual deceleration occurs because the lift arm 40 is decelerating and the linkage is controlled by the rotation of the lift arm.

Although this invention has been disclosed and illustrated with reference to particular embodiments, the principles involved are susceptible for use in numerous other embodiments which will be apparent to persons skilled in the art. The invention is, therefore, to be limited only as indicated by the scope of the appended claims.

We claim:

1. A device for lifting and loading materials comprising:

a frame including a storage container having an inlet opening that is located above ground level;

a pick-up arm for engaging material at ground level for loading through the inlet opening of storage container;

a lift assembly for the pick-up arm including a lift arm connected at one end portion to the frame and at another end portion to the pick-up arm;

first actuating means for swinging the pick-up arm relative to the lift arm about an axis that is generally perpendicular to the ground to bring the pick-up arm into a close-in position along the section of the storage container where the inlet opening is located and a outreaching position spaced away from that section; and second actuating means for moving the lift arm relative to the frame between a load level, at which the pick-up arm is located at a selected height near ground level, and an off-load level, at which the pick-up arm is raised to the level of the inlet opening; and first controlling means interconnecting the first and second actuating means for automatically moving the pick-up arm into the outreaching position as the lift arm moves toward the load level, thereby permitting access to materials located away from the storage container, and for automatically moving the pick-up arm into the close-in position as the lift arm moves toward the off-load level, thereby facilitating the off-loading of such materials through the inlet opening and into the storage container.

2. A device as defined in claim 1 and wherein the lift arm further includes third actuating means for moving the pick-up arm relative to the lift arm about an axis that is generally parallel to the ground.

3. A device as defined in claim 2 and further including second controlling means interconnecting the second actuating means and the third actuating means for automatically maintaining the pick-up arm in a desired relationship relative to the lift arm as the lift arm moves between the load level and a predetermined level above ground level.

4. A device according to claim 2 wherein the third actuating means is operative for moving the pick-up arm between a load position, in which materials engaged by the pick-up arm are held generally parallel to the ground, and an off-load position, in which materials engaged by the pick-up arm are tipped in the direction of the inlet opening of the storage container top facilitate off-loading therein.

5. A device according to claim 4 and further including second controlling means interconnecting the second actuating means and the third actuating means for automatically maintaining the pick-up arm in the load position as the lift arm moves between the load level and a predetermined level above ground level.

6. A device according to claim 5 wherein the second controlling means is further operative for automatically moving the pick-up arm from the load position to the off-load position as the lift arm moves between the predetermined above-ground level and the off-load level.

7. A device according to claim 4 and further including second controlling means interconnecting the second actuating means and the third actuating means for automatically moving the pick-up arm between the load position to the off-load position in response to the movement of the lift arm between the load level and the off-load level.

8. A device according to claim 1 wherein the first actuating means and the second actuating means are actuated by fluid pressure.

9. A device according to claim 3 wherein the first, second, and third actuating means are actuated by fluid pressure.

10. A device according to claim 9 wherein the fluid pressure is hydraulic pressure.

11. A device according to claim 2 and further including fourth actuating means for moving the lift arm relative to the frame from an first position close to the frame and a second position spaced away from the frame.

12. A device according to claim 11 wherein the actuating means are actuated by fluid pressure.

13. A device according to claim 12 wherein the fluid pressure is hydraulic pressure.

14. A device according to claim 1 and further including means for selectively disabling the first controlling means to maintain the pick-up arm in the close-in position during movement of the lift arm between its load and off-load levels.

15. A device for lifting and loading materials comprising:

a frame including a storage container having an inlet opening that is located above ground level;

a pick-up arm for engaging material at ground level for loading through the inlet opening of storage container;

a lift assembly for the pick-up arm including a lift arm connected at one end portion to the frame and at another end portion to the pick-up arm; and first actuating means for swinging the pick-up arm relative to the lift arm about an axis that is generally perpendicular to the ground to bring the pick-up arm into a close-in position along the section of the container where the inlet opening is located and a outreaching position spaced away from that section, said first actuating means including speed control means for automatically increasing the velocity of movement of the pick-up arm as it moves from the outreaching position toward the close-in position until a desired intermediate position is reached and for then automatically decreasing the velocity of movement of the pick-up arm as it moves from the intermediate position toward the close-in position.

16. A device according to claim 15 wherein the speed control means is further operative for automatically increasing the velocity of movement of the pick-up arm as it moves from the close-in position toward the intermediate position and then decreasing the velocity of movement as the pick-up arm moves from the intermediate position toward the outreaching position.

17. A device according to claim 16 and further including second actuating means for moving the lift arm relative to the frame between a load level, at which the pick-up arm is located at a selected height near ground level, and an off-load level, at which the pick-up arm is raised to the general level of the inlet opening.

18. A device according to claim 17 and further including first controlling means interconnecting the first and second actuating means for automatically moving the pick-up arm into the outreaching position as the lift arm moves toward the load level, thereby permitting access to materials located away from the storage container, and for automatically moving the pick-up arm into the close-in position as the lift arm moves toward the off-load level, thereby facilitating the off-loading of such materials through the inlet opening and into the storage container.

19. A device as defined in claim 16 and further including third actuating means for moving the pick-up arm relative to the lift arm about an axis that is generally parallel to the ground.

20. A device for use with a cab for lifting and loading a collection container holding materials, including, a frame including a storage container constructed to be disposed rearwardly of the cam and having an inlet opening located above ground level, a pick-up arm for engaging the collection container holding the material, a control lever movable to different positions, a lift assembly for the pick-up arm and having first and second end portions and including a lift arm, including the lift arm being connected near the first end portion to the frame and near the second end portion to the pick-up arm, actuating means for moving the lift arm relative to the frame upwardly and rearwardly between a load level, at which the pick-up arm is disposed to engage the collection container while the collection container is disposed on the ground, and an off-load level, at which the pick-up arm is raised to a level at least corresponding to the level of the inlet opening in the storage container, means for moving the lift arm to positions laterally displaced from the collection container and the cab to extend the range in which the pick-up arm is able to engage the collection container, means responsive to the movement of the control lever to different positions for independently providing for the upward and rearward movement of the lift arm end for providing for the movement of the lift arm to the laterally displaced positions, means for moving the pick-up arm between a close-in position extending forwardly from the cab and an outreaching position extending transversely of the cab to extend the range through which the pick-up arm is able to engage the collection container, means responsive to the movement of the control lever to different positions for providing for the movement of the pick-up arm between the close-in position and the outreaching position independently of the upward and rearward movement of the lift arm and the movement of the lift arm to the laterally displaced positions, means operatively coupled to the moving means for the lift arm and the moving means for the pick-up arm for moving the pick-up arm from the outreaching position to the close-in position during the movement of the lift arm upwardly and rearwardly from the load level to the off-load level, and means for providing for an increased rate of movement of the lift arm upwardly and rearwardly during an initial portion of such movement and an increased rate of movement of the pick-up arm between the outreaching position and the close in position during such initial portion of such movement and for providing for a decreased rate of movement of the lift arm upwardly and rearwardly during a subsequent portion of such movement and for providing for a decreased rate of movement of the pick-up arm between the outreaching position and the close-in position during such subsequent portion of such movement.

21. A device for use with a cab for lifting and loading collection containers holding materials, including, a frame including a storage container constructed to be disposed rearwardly of the cab and having an inlet opening above ground level for passing the material from the collection container through the inlet opening into the storage container, a pick-up arm for engaging the collection containers holding the material, the pick-up arm being movable between a close-in position extending forwardly from the cab and an outreaching position extending transversely to the close-in position, a control lever movable to different positions, a lift assembly for the pick-up arm, including first and second end portions, the lift assembly including a lift arm connected near the first end portion to the frame and near the second end portion to the pick-up arm, actuating means for moving the lift arm relative to the frame upwardly and rearwardly between a load level, at which the pick-up arm engages the collection container while the collection container is disposed on the ground, and an off-load level, at which the pick-up arm is raised to a position at least corresponding to the level of the inlet opening in the storage container, means responsive to the movement of the control lever to different positions for independently providing for the upward and rearward movement of the lift arm and the movement of the pick-up arm between the close-in and outreaching positions, means operatively associated with the lift arm and the pick-up arm for providing for the movement of the pick-up arm from the outreaching position to the close-in position during the upward and rearward movement of the lift arm, means for positioning the pick-up arm during the upward and rearward movement of the lift arm to maintain the collection container upright during the movement of the lift arm from the load level and for tilting the collection container toward the inlet opening as the collection container approaches the inlet opening in accordance with the upward and rearward movement of the lift arm, and means for initially increasing and subsequently decreasing the rate of the upward and rearward movement of the lift arm, and the rate of movement of the pick-up arm from the outreaching position to the close-in position, during the movements of the lift arm from the load level.

22. A device for use with a cab for lifting and loading collection containers holding materials, including, a storage container, a frame for supporting the storage container rearwardly of the cab, first means including a lift arm operatively coupled to the frame for pivoting the lift arm upwardly and downwardly, second means operatively coupled to the lift arm for grabbing the storage container during the pivotal movement of the lift arm upwardly and downwardly, third means operatively coupled to the lift arm for providing an acceleration of the lift arm through a first distance in the pivotal movement of the lift arm upwardly and downwardly and for providing a deceleration of the lift arm through a second distance in the pivotal movement of the lift arm upwardly and downwardly, a pick-up arm pivotable laterally between a close-in position and an outreaching position, the second means being disposed at the end of the pick-up arm, fourth means operatively coupled to the pick-up arm for pivoting the pick-up arm laterally to the close-in position from the outreaching position as the lift arm is pivoted upwardly, and fifth means for accelerating the pivotal movement of the pick-up arm by the fourth means during the acceleration in the pivotal movement of the lift arm upwardly and downwardly and for decelerating the pivotal movement of the pick-up arm by the fourth means during the deceleration in the pivotal movement of the lift arm upwardly and downwardly.

23. A device for use with a cab for lifting and loading collection containers holding materials, including, a storage container, a frame for supporting the storage container rearwardly of the cab, a pick-up arm pivotable laterally between a close-in position and an outreaching position, first means supported by the pick-up arm for grabbing the storage container, a lift arm pivotable vertically between lowered and raised positions, second means operatively coupled to the lift arm and the pick-up arms for pivoting the lift arm vertically between the ground and raised positions and for simultaneously pivoting the pick-up arm laterally between the close-in position and the outreaching position, third means for disabling the second means to provide for the pivotal movement vertically of the lift arm independently of the pivotal movement laterally of the pick-up arm and for the pivotal movement laterally of the pick-up arm independently of the pivotal movement vertically of the lift arm, and means for concurrently accelerating the pivotal movements of the lift arm and the pick-up arm during first portions of such pivotal movements and for concurrently decelerating the pivotal movements of the lift arm and the pick-up arm during subsequent portions of such movements.

* * * * *

UNITED STATES PATENT AND TRADEMARK OFFICE

CERTIFICATE OF CORRECTION

PATENT NO. : 5,470,187
DATED : November 28, 1995
INVENTOR(S) : Fred T. Smith, et. al.

It is certified that error appears in the above-indentified patent and that said Letters Patent is hereby corrected as shown below:

Column 2, line 40, "an" should read --"a"--.

Column 17, line 33, "cam" should read "cab"--.

Signed and Sealed this

Second Day of July, 1996

Bruce Lehman

*Attest:*

BRUCE LEHMAN

*Attesting Officer*

*Commissioner of Patents and Trademarks*